US007946521B2

(12) United States Patent
Crawford

(10) Patent No.: US 7,946,521 B2
(45) Date of Patent: May 24, 2011

(54) WINCH DRUM ASSEMBLY AND METHOD FOR SPOOLING A LINE

(75) Inventor: Alexander Charles Crawford, Newport-on-Tay (GB)

(73) Assignee: Deep Tek Winch IP Limited, Fife (GB)

( * ) Notice: Subject to any disclaimer, the term of this patent is extended or adjusted under 35 U.S.C. 154(b) by 0 days.

(21) Appl. No.: 12/448,960

(22) PCT Filed: Feb. 1, 2008

(86) PCT No.: PCT/GB2008/000323

§ 371 (c)(1),
(2), (4) Date: Jul. 15, 2009

(87) PCT Pub. No.: WO2008/093089

PCT Pub. Date: Aug. 7, 2008

(65) Prior Publication Data

US 2010/0059620 A1 Mar. 11, 2010

(30) Foreign Application Priority Data

Feb. 1, 2007 (GB) ..... 0701870.8
Nov. 3, 2007 (GB) ..... 0721614.6

(51) Int. Cl.
*B65H 57/00* (2006.01)

(52) U.S. Cl. ..... 242/397.2; 242/548.1

(58) Field of Classification Search ..... 242/397, 242/397.2, 397.3, 548, 548.1, 613, 613.1, 242/613.2; 254/385
See application file for complete search history.

(56) References Cited

U.S. PATENT DOCUMENTS

| | | | | |
|---|---|---|---|---|
| 1,822,422 | A * | 9/1931 | Richardson | 242/613.1 |
| 2,892,598 | A * | 6/1959 | Dudley | 242/903 |
| 3,815,846 | A * | 6/1974 | Biewer | 242/397.3 |
| 3,951,355 | A | 4/1976 | Morioka et al. | |
| 4,005,834 | A * | 2/1977 | Landreau | 242/478.1 |
| 4,071,205 | A * | 1/1978 | Wieschel | 242/602.2 |
| 4,334,670 | A * | 6/1982 | Kawabe | 242/397.3 |
| 4,413,792 | A * | 11/1983 | O'Connor | 242/471 |
| 4,655,399 | A * | 4/1987 | Harvey | 242/397.3 |
| 5,497,954 | A | 3/1996 | Johansson | |
| 6,443,431 | B1 * | 9/2002 | Stasny et al. | 254/385 |
| 6,601,794 | B2 * | 8/2003 | Brutschin | 242/613 |
| 2006/0071116 | A1 * | 4/2006 | Quenneville et al. | 242/397.3 |
| 2006/0151653 | A1 * | 7/2006 | Talen | 242/397.3 |

FOREIGN PATENT DOCUMENTS

| | | |
|---|---|---|
| DE | 1 801 427 | 10/1968 |
| GB | 350917 | 12/1929 |
| JP | 01313263 A2 | 12/1989 |

* cited by examiner

*Primary Examiner* — William A Rivera
(74) *Attorney, Agent, or Firm* — Drinker Biddle & Reath LLP

(57) ABSTRACT

A winch drum assembly has a barrel to receive a line, and a spooling device for guiding the line onto the barrel. The line is wound onto the barrel at a point that moves axially with respect to the barrel, and the orientation of the line on the barrel is adapted to change at least once per revolution of the barrel, so that radially adjacent layers of line are non-parallel. Spooling gear is described for guiding the line and the barrel can have ramps and walls to guide the line in the different directions. Non-parallel layers of line exhibit a reduced tendency to interfere with one another, so that the spooled line comes off the barrel more consistently.

27 Claims, 23 Drawing Sheets

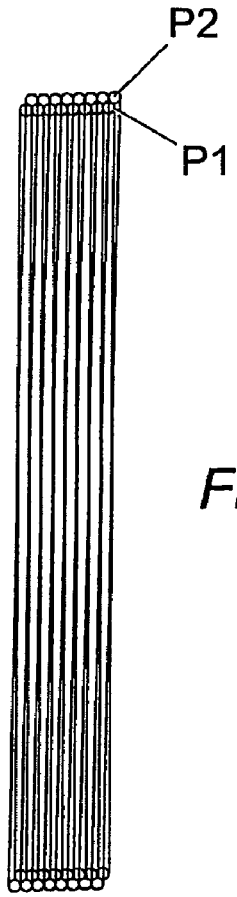
Fig. 1
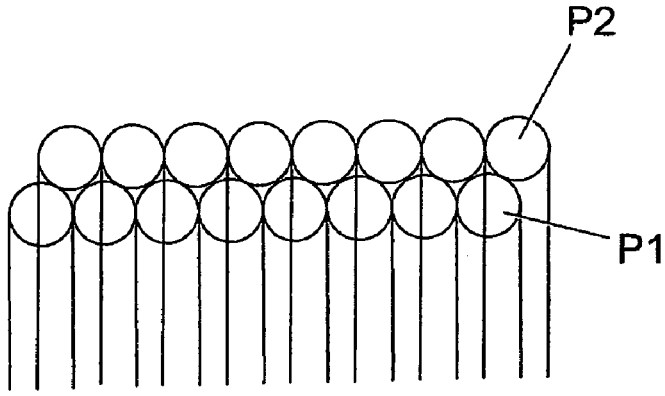
Fig. 2
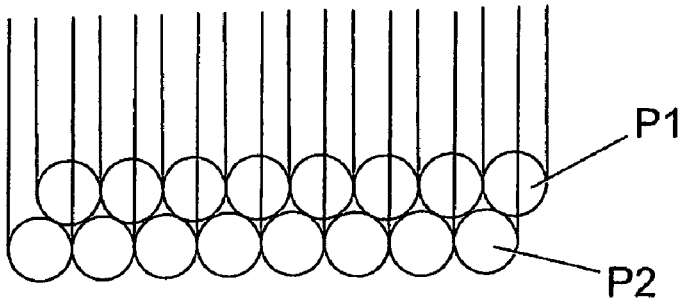

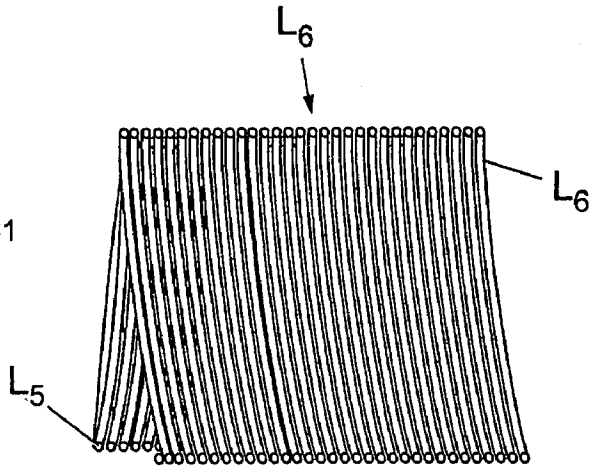
Fig. 24
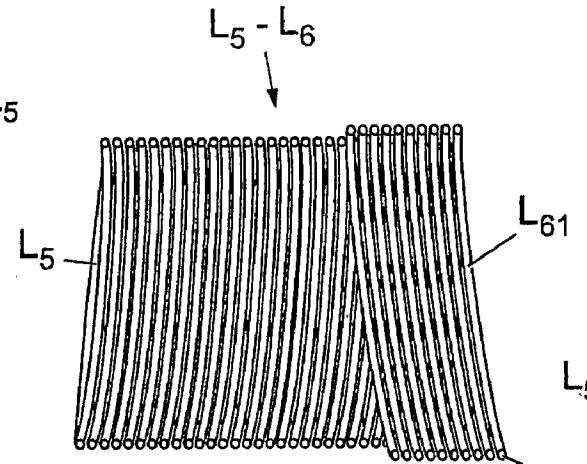
Fig. 25
Fig. 26
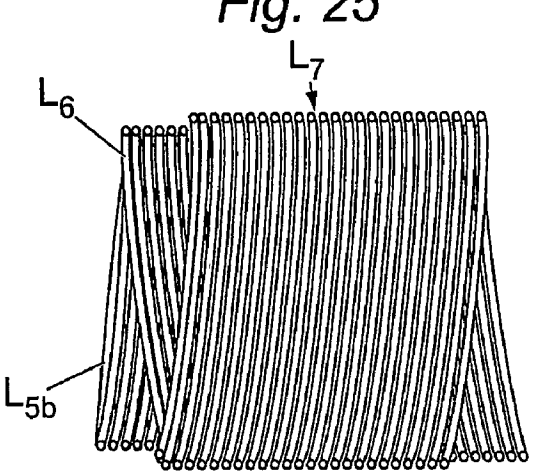
Fig. 27
Fig. 28
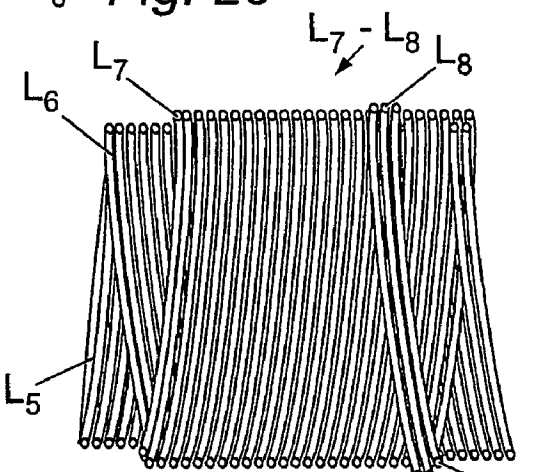
Fig. 29

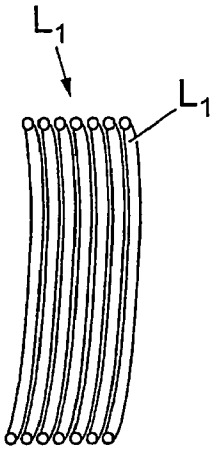
Fig. 30
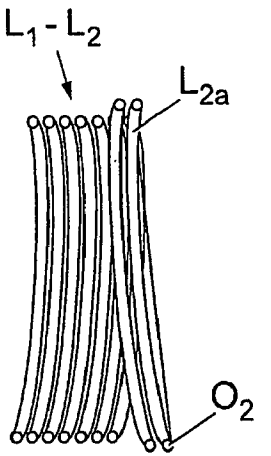
Fig. 31
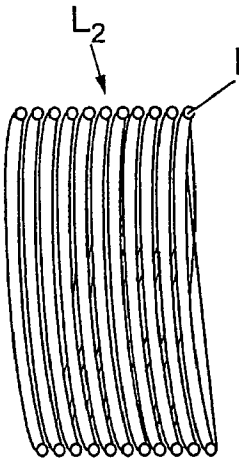
Fig. 32
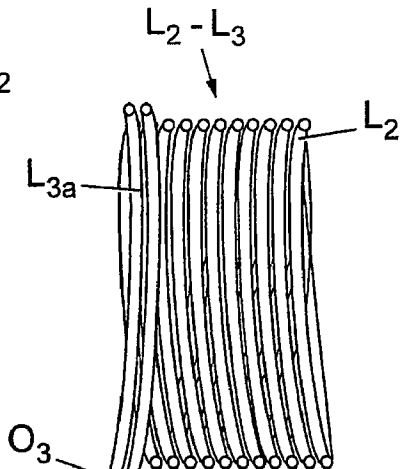
Fig. 33
Fig. 34
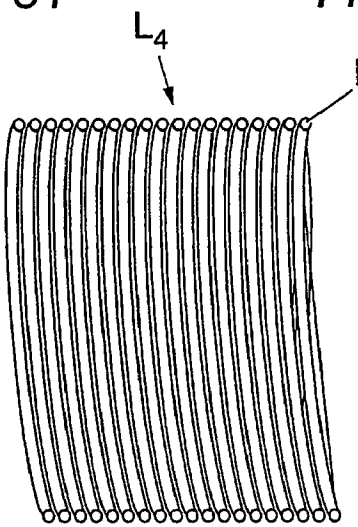
Fig. 35
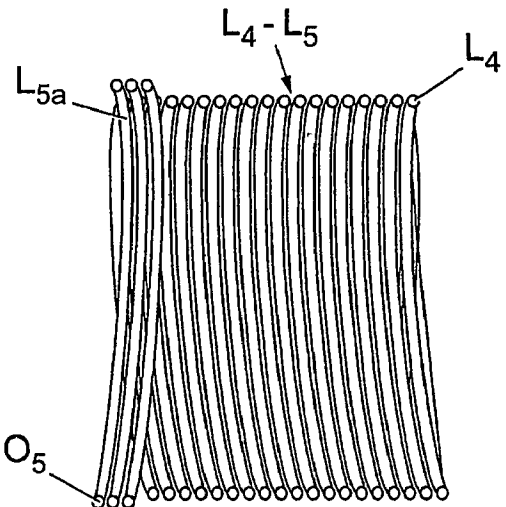
Fig. 36

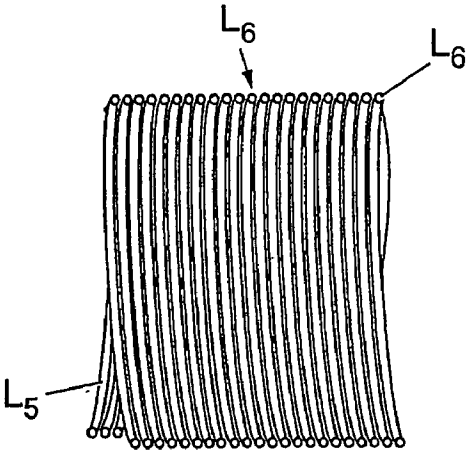
Fig. 37
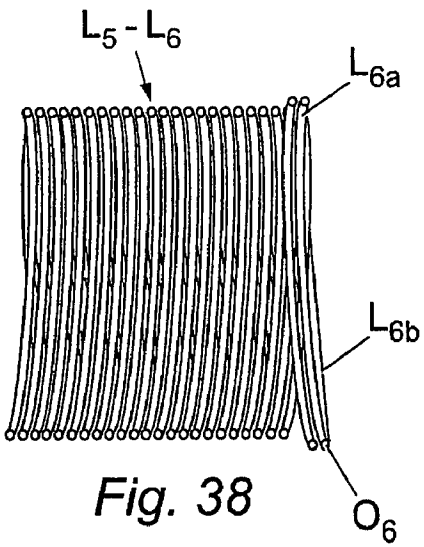
Fig. 38
Fig. 39
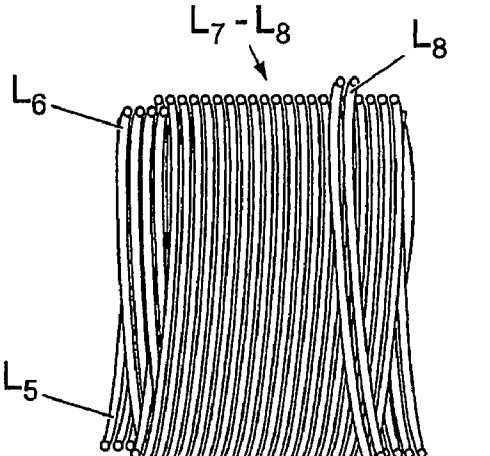
Fig. 40
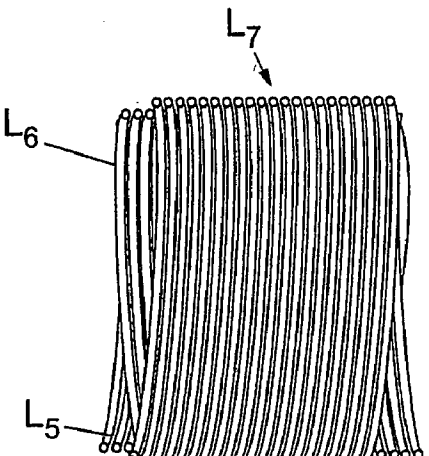
Fig. 41
Fig. 42

WINCH DRUM ASSEMBLY AND METHOD FOR SPOOLING A LINE

This Application is the U.S. National Phase Application of PCT International Application No. PCT/GB2008/000273 filed Jan. 28, 2009

This invention relates to a winch drum assembly and to a method for spooling a line such as a rope.

DESCRIPTION OF THE RELATED ART

Lines and ropes are traditionally wound (or "spooled") onto flanged drums and barrels for storage and to facilitate paying out of the line as it is needed. The line is typically distributed evenly along the length of the axis of the barrel so that the maximum amount of line can be wound onto a single barrel. For this purpose, spooling gear is typically employed to guide the line onto the barrel surface in the desired position along the axis of the barrel. Existing designs of spooling gear comprise a line-receiving spooling head constrained to move along a cylindrical spooling bar. The bar typically has a helical path or thread cut along its length in order to retain a boss or some other formation connected to the spooling head that guides the line. As the spooling bar is rotated with the boss of the spooling head located within the helical slot, the spooling head moves along the axis of the spooling bar in order to guide the line onto the surface of the barrel at the preferred axial spacing. Typically, the rotation of the winch drum onto which the line is being spooled drives the rotation of the spooling bar through appropriate gear mechanisms so that the horizontal movement of the spooling head is linked to the speed of the winch drum. When the spooling head reaches the end of the slot on the spooling bar, this typically coincides with the line reaching the opposite flange of the winch barrel, and the boss on the spooling head then typically enters a return slot that traverses back towards the starting position of the spooling head. Typically, the two slots intersect on the surface of the spooling bar, creating a diamond-shaped pattern. Thus, the spooling bar drives the spooling head from one side of the barrel to the other without changing the direction of rotation of the spooling bar. Using this process, the first layer of line is wound onto the drum substantially as shown in FIG. 1, which illustrates a typical prior art method of spooling.

In this prior art method, consecutive rows in each layer are laid straight and parallel at an angle across the axis of the drum. Also, as the second layer P2 is spooled on top of the first layer P1, each row of the second layer P2 is guided into the groove formed between adjacent rows of the layer below it P1, as shown in FIG. 2. This gives stability to the second layer P2, and mitigates slippage of the rows in it.

This method works very well with wire, and with conventional fibre ropes that are suited for low loads. However, with high strength fibre ropes, this method tends to be unsuitable, because any given upper layer of the soft fibre rope tends to deform and squeeze (or "bite") in between the rows in the layer beneath when put under heavier loads, and this can trap or wear the rope.

In order to avoid this problem with fibre lines, the speed of the spooling bar relative to the barrel is generally faster then it would be for wire line. This prevents the line in any one layer biting into the previous layers by producing a pattern that crosses over the layer beneath it at such an angle that it cannot slip between the rows of line in the immediately preceding layer. Generally, the angle at which the fibre line is spooled is much closer to the axis of the drum than to the near perpendicular arrangements shown in FIGS. 1 and 2.

Speeding up the spooling of line in this manner lays the line in a long shallow pitch helix along the winch barrel similar to a course thread cut on a set screw. Thus, the line no longer lies as a smooth flat layer with parallel rows, but produces gaps in each layer between adjacent rows. The gaps reduce the amount of line that can be spooled onto the drum.

The method is quite suitable for two or three layers of line, but eventually as the layers build up, gaps between the rows in each layer increase, and the line in an upper layer may eventually slide or bite into a gap in the layer beneath it, causing both noise and unnecessary wear on the line.

BRIEF SUMMARY OF THE INVENTION

The present invention provides a winch drum assembly having a barrel adapted to receive a line, and having a spooling device for guiding the line onto the barrel as the barrel and the spooling device rotate relative to one another, such that the line is spooled onto the barrel at a point that moves axially with respect to the barrel, and wherein the axial direction of the line spooled onto the barrel is adapted to change at least once per revolution of the barrel with respect to the spooling device.

In some embodiments the barrel rotates relative to the spooling head, which remains rotationally static relative to the barrel. In other embodiments the barrel can remain static and the spooling device can rotate around it.

Typically the orientation of the line on the barrel is controlled by a spooling device such as a spooling head that receives the line and typically moves axially with respect to the barrel to guide the feed point of the line (the position on the barrel at which the line is spooled onto it) along the axis of the barrel. In certain embodiments the spooling of the line on the barrel can be controlled or guided by grooves formed in or on the barrel that guide initial layers of the line into selected orientations, directions or locations as it is wound onto the barrel. The spooling device and/or the grooves can optionally direct the changes in direction of the line as it is wound onto the barrel, so that successive layers of line wound onto the barrel are non-parallel to the layers immediately above and below. The axial direction of spooling typically reverses at least once in each revolution. For example, in one half cycle, the line can be spooled on towards one flange of the barrel, and in the other half cycle the line can be spooled on towards the opposite flange.

The present invention also provides a method of spooling a line on a barrel of a winch, the method comprising guiding the line onto the barrel by means of a spooling device, wherein the spooling device and the barrel rotate relative to one another during spooling of the line onto the barrel, wherein the spooling device causes the line to move axially with respect to the barrel as the barrel rotates, and wherein the spooling device causes the line to change axial direction of spooling at least once per revolution of the barrel relative to the spooling device.

Typically the line is guided onto the rotating barrel by means of a spooling head that moves axially with respect to the barrel as the barrel rotates relative to the spooling device, and wherein the spooling device changes direction at least once per revolution of the barrel.

Typically the barrel is a winch barrel with flanges. Typically the winch has a load bearing capacity of more than 250 kg, optionally above 500 kg, and especially for heavy lifting marine winches with a load-bearing capacity more than 20 tonnes, e.g. 20-100 tonnes.

The spooling device typically comprises a spooling head that is driven parallel to the axis of the barrel in order to guide the line onto the barrel as the barrel rotates.

Typically it is the axial direction of movement of the spooling head that changes, so that the head reverses its movement along the axis of the barrel (for example) from right to left, and starts to move from left to right. Typically the drum remains axially stationary while the spooling head moves axially with respect to it, but it is only necessary for relative movement between the two.

The axial direction of the spooling device typically changes (e.g. reverses) twice in each rotation of the barrel. Typically when the barrel is in its first half cycle between 0° and 180°, the line is wound onto the barrel in a first direction, and in the second half of the cycle of the barrel between 180° and 360°, the line is wound onto the barrel in a second direction. The first direction typically has a first angular component, and the second direction has a second angular component. Typically, the first angular component is approximately 1° to 10° deviation from perpendicular with respect to the axis of the barrel. A preferred range is 3° to 5°. The second angular component is typically substantially the same value, but in the opposite direction. At the next revolution of the barrel the spooling head typically resumes movement in the first direction by reversing its movement again as the barrel reaches the end of its first revolution and begins its second revolution.

The spooling head can be controlled by hydraulic means using motors or cylinders, or by linear motors capable of synchronising the reversal of direction of the spooling head with respect to each rotation of the barrel.

Mechanical means with clutches, cams and other methods to change to the axial direction of movement can also be employed. However, in preferred embodiments of the invention, the movement of the spooling head is controlled by a programmable electronic servomotor. This can drive a threaded bar on which the spooling heads are driven in either direction parallel to the axis of the barrel.

The spooling head typically has a roller guide capturing the line and providing roller devices to guide the line, retain it in the spooling head, and to reduce the friction of the line against the spooling head.

The spooling head can reverse direction any suitable number of times, for example, only once or more than twice per rotation of the barrel if desired. Preferably the change of direction of the spooling head, and thus of the path of the line on the barrel, takes place at the same rotational position on the barrel with each revolution, so that adjacent lines bend at the same rotational position on the circumference of the barrel, and lie parallel to one another, taking up the minimum amount of axial space between the flanges on the barrel. Two reversals of direction of the spooling head per rotation is preferred (including the resumption of the first direction for the second revolution) since this generates the least amount of wear on the line, and permits the maximum use of axial space on the barrel.

Radially adjacent layers are typically laid from opposing ends of the barrel. Thus, the first direction of movement of the spooling head at the start of the revolution typically differs between radially adjacent layers of line on the barrel. On a first layer of line being spooled onto the barrel, the spooling head commences at one end of the barrel, for example at the left hand flange, and moves axially to the right, parallel to the axis of the barrel as it rotates. When the barrel has rotated half a turn for example, the spooling bar is then reversed to traverse from right to left, back towards the left hand flange, again typically remaining parallel to the axis of the barrel as it rotates. Thus the line extends from left to right in the first half of the barrel's rotation (between 0° and 180°) reverses direction at 180° on the circumference of the barrel, and then moves from right to left during the second half of the revolution (between 180° and 360°). The return excursion of the spooling head during the second half of the revolution of the barrel typically does not return the spooling head back to the origin. The axial distance travelled during the return excursion can be slightly less than the axial distance travelled during the outward excursion from left to right. The difference between the two excursions is typically programmed into the control mechanism for the spooling head, in order to account for the thickness of the line on the barrel surface. Thus, with a line thickness of 10 cm, the outward excursion from left to right might be 50 cm, and the return excursion might be 40 cm. When the barrel has completed one revolution, and the rotational position of the barrel has returned to its starting point at 0° on the circumference of the barrel, the axial direction of movement of the spooling bar again changes back to move from left to right for another 50 cm outward excursion during the first half of the next revolution in order to lay the second row of line parallel to the first. When the rotational position of the barrel again reaches 180° on the second revolution, the spooling head again changes its axial direction of movement to initiate a return excursion from right to left for 40 cm, in order to lay the second half of the second row parallel to the second half of the first row. It is useful but not essential for the adjacent rows in each layer to be touching, and they can be spaced apart in certain embodiments by programming a difference between the outward and return excursions of the spooling head that is larger than the width of the line. For example, with a line width of 10 cm, the outward excursion could be 70 cm, and the return excursion could be 50 cm, with a difference (or "stagger") of 10 cm per revolution.

In some embodiments, a formation may be provided extending radially outward from the surface of the barrel, perpendicular to the axis of rotation of the barrel. The formation can be a radial projection and can typically be spaced at the rotational position on the barrel at which the line (and spooling head) will change direction, so that the line bends around the radial projection extending from the surface of the barrel, and does not slip back towards the origin across the surface of the barrel. The radial projection can be a wall, or a boss or the like, and is typically only necessary in the first layer of line that is spooled onto the barrel, because the friction between radially adjacent layers of the line as it is being spooled onto the barrel is often sufficient to prevent slippage even when the direction of the line changes on the barrel surface, but formations can optionally be provided for subsequent layers if desired. The or each formation can extend radially far beyond the first layer in some cases for example as far as the outermost layer of the line on the barrel) or can optionally extend only as far as the first layer. The wall of the formation can be perpendicular to the axis of rotation or can be inclined at a shallower angle.

In certain embodiments, the formation can be adapted to guide the radial and axial paths of the line with respect to the barrel. In some cases, the formation can be stepped. For example, the radial and axial dimensions of the wall etc can be variable with respect to the radial depth of the barrel, so that in one layer of line, e.g. the first layer of line, the wall can extend axially inwards from the flange towards the mid-point between the flanges. Optionally the steps of the wall can be of similar radial depth to the line thickness, or can be multiples thereof, so that the next layer of line, e.g. the second layer, can optionally extend from the end of the first layer over the top of the first wall while still being aligned with the rest of the rows in the second layer. Typically, the wall that axially supports the second (or further) layer can have a shorter axial extension than the first wall. The formation can be grooved.

Optionally, the wall can be symmetrical around the midpoint of the drum between the flanges. However, in some cases, it is advantageous to have an asymmetric arrangement of the wall on each flange. In stepped embodiments the steps can be asymmetric.

In certain embodiments, the walls can have ramps to gradually guide the path of the line in radial as well as axial directions. This reduces the extent to which sudden diversions of the path of the line can lead to discontinuities such as bumps and pits in the surface of the layers of the wound line. Typically, the wall at the flange towards which a layer is being wound has a ramp to gradually raise the radial height of the line from one layer to the next, as it approaches the turning point of the line. Typically the ramps guide the path of the line from the depth of one layer (e.g. the first layer) to the correct depth for the first row of the next layer (e.g. the second layer). The change in depth of the ramps can be gradual or stepped. The ramps can be grooved.

In certain embodiments, the layers of line spooled on to the barrel can be made up of line that is spooled in different directions. For example, a single layer of line wound onto one layer on the barrel can be made up from line wound on one excursion of the spooling head travelling in one direction, and line wound on another excursion when the spooling head is travelling in another direction. In other words, a single excursion of the spooling head in a single direction can spool line onto more than one layer, e.g. two layers, three layers or even more. This variation can be useful to spool the line onto the drum in a more compact manner, which results in an axially narrower barrel.

In some embodiments, the outer surface of the barrel can be grooved in order to guide the first layer of line onto particular areas of the barrel surface.

It will be appreciated that at the rotational position of the barrel at which the line changes direction (or "apex") there may be an unused gap between the line and the flange on the barrel surface. In certain embodiments of the invention, every second layer (for example the first, third and fifth layers) can be spooled radially on top of one another at the same rotational position on the barrel circumference, thereby creating the gap in each layer at the same rotational position on the barrel. Where the formations are shaped to intrude into the gap area this can be useful if providing a radial protrusion at which the apex of the line can form so as to achieve a predictable and consistent displacement of the line on the barrel. However, in certain cases, each second layer of line can be spooled on at different rotational positions, by stopping the axial movement of the spooling head at the opposite flange before the return journey while the barrel rotates for a short distance, usually less than a full revolution. Thus the origin of the second layer on the barrel can be circumferentially different from the origin of the first layer. Adjacent layers can be staggered in this way, or non-adjacent layers, such as every second layer can be staggered as well. This distribution of the line on the barrel can prevent the formation of gaps into which the line might be drawn.

The line is typically a high strength fibre rope with a capacity of more than 1000 kg. Typical capacities of line for which the invention is suitable are 20-200 tonnes.

The invention also provides a winch drum adapted to receive a line onto a barrel in layers, in which the rows of line in one layer on the barrel are non-parallel to the rows of line in adjacent layers above and/or beneath the one layer.

The invention also provides spooling gear for guiding line onto a winch drum in non-parallel layers.

The invention also provides a winch drum having a barrel adapted to receive a line that is wound around the barrel, the barrel having a guide device for guiding the line onto the barrel, wherein the guide device guides the line onto the barrel at a point that moves axially with respect to the barrel as the barrel rotates and wherein the guide device is adapted to change the axial direction of winding of the line onto the barrel at least once per winding revolution.

Since the rows in each layer can be parallel to one another the amount of line that can be spooled onto the barrel is greater than could be achieved previously, but since the layers can be laid onto the barrel so as to be non-parallel to one another this reduces the tendency for radially adjacent layers to interfere with one another, and so the line can be spooled off the barrel more consistently.

BRIEF DESCRIPTION OF THE SEVERAL VIEWS OF THE DRAWINGS

An embodiment of the invention will now be described by way of example and with reference to the accompanying drawings, in which:

FIGS. 1 and 2 show prior art methods of winding line;

FIG. 9 shows the FIG. 7 barrel with both first and second layers spooled on;

FIG. 12 shows a cumulative view similar to FIGS. 9 and 6 with the first, second and third layers spooled on;

FIG. 13 shows a flat view of a winch barrel with first and second layers spooled on;

FIG. 14 shows an end view of the barrel after seven layers have been spooled on;

FIG. 24 shows a schematic view similar to FIG. 16, showing the $5^{th}$ layer of line;

FIG. 25 shows a schematic view similar to FIG. 16, showing line 5 and the start of a $6^{th}$ layer of line;

FIG. 26 shows a schematic view similar to FIG. 16, showing the $6^{th}$ layer of line;

FIG. 27 shows a schematic view similar to FIG. 16, showing line 6 and the start of a $7^{th}$ layer of line;

FIG. 28 shows a schematic view similar to FIG. 16, showing the $7^{th}$ layer of line;

FIG. 29 shows a schematic view similar to FIG. 16, showing lines 6 and 7, and the start of a $8^{th}$ layer of line;

FIGS. 30-42 show views of a further embodiment of a method of spooling a line, similar to the views shown in FIGS. 16-29, but with a 4° angle of line;

DETAILED DESCRIPTION OF THE INVENTION

Figure 3:
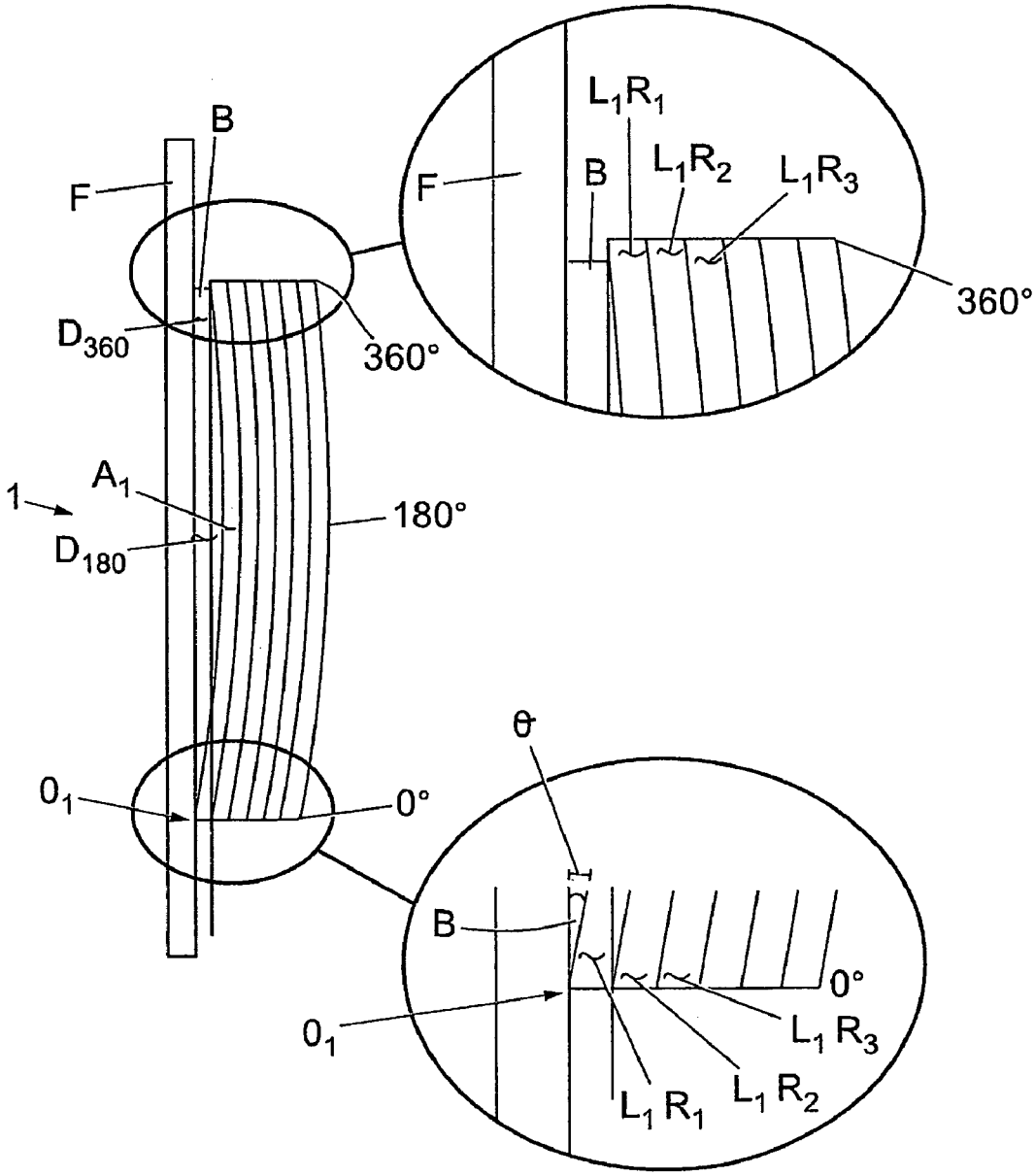
FIG. 3 shows a schematic plan view of the surface of a winch barrel that has been represented as a flat sheet from 0° to 360°, and in which (in the 3-dimensional barrel) the top of the representation at 360° connects seamlessly with the bottom of the representation at 0°.
Figure 6:
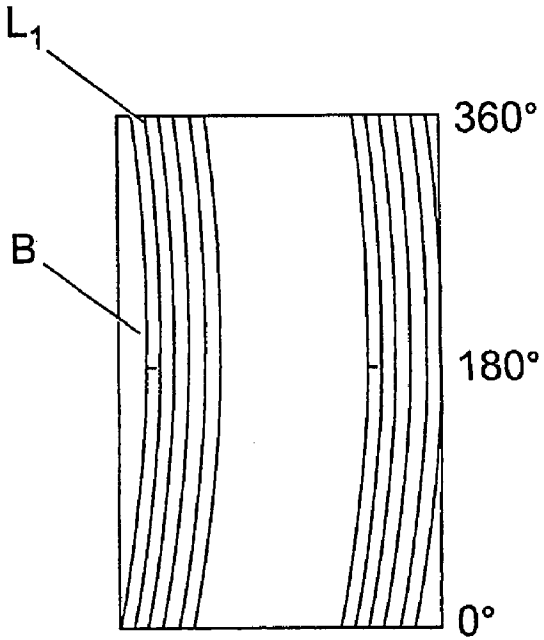
FIG. 6 shows a view similar to FIG. 4 with the first layer wound onto the FIG. 4 barrel. Note that for clarity in each of the flat views, the beginning and end rows of line are shown, but the middle rows (which are identical) are not.
Figure 5:
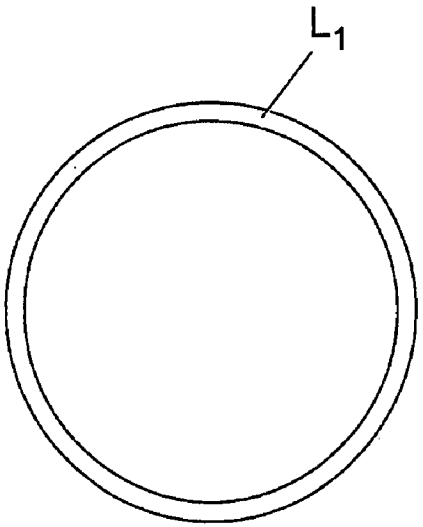
FIG. 5 shows an end view of the FIG. 4 barrel.

Referring now to the drawings, a marine winch drum 1 (FIG. 3) has a cylindrical barrel B on which a line is wound, and a flange F at each end of the cylindrical barrel B to prevent the spooled line from sliding off the end of the barrel B. The FIG. 3 view is schematic. Rather than showing a true cylindrical representation of the 3-D barrel B and flange F, the drum is shown as if its surface had been cut along a line parallel to its axis and laid flat, so that the whole of the surface of the barrel on which the line is wound can be seen in the plane of the figure. FIGS. 4, 6, 7, 9, 10 and 12 show similar views.

The line is initially fixed to an anchor point typically at the junction between the barrel B and the flange F, which defines the starting position (or origin O1) for the first layer. The rotational position of the origin O1 on the barrel is notionally defined as 0°. It will be understood that in the flat representations of the winch drum in the figures, the top and bottom portions of the line and the barrel at 0° and 360° connect seamlessly at the origin O1 in the 3-D winch drum.

Once the line is fastened to the drum at the origin O1, it is passed through a roller device on a spooling head controlled by an electronic programmable servomotor that rotates a threaded spooling bar to which the spooling head is connected via a nut or other threaded connector to mesh with the threaded spooling bar. The rotation of the threaded spooling bar is controlled by a logic device receiving input from the rotation of the winch drum 1, so that the threaded spooling bar is rotated in accordance with the rotation of the winch drum 1, according to the programming of the logic device. The rotation of the spooling bar drives the spooling head axially along the bar. The spooling bar is disposed parallel to the axis of the drum 1.

Once the line is attached at the origin O1 and threaded through the spooling head, the winch drum 1 is rotated clockwise and the first row of the first layer L1R1 is laid onto the outer surface of the barrel B. As the drum 1 rotates, the spooling bar drives the spooling head axially from left to right in order to wind the first row onto the drum at an initial angle θ, which is dependent on the desired spacing between the different rows in each layer, and on the width of the line, but is typically around 3-10° and more usefully 5-7°. Thus the path taken by the line on the drum is not perpendicular and parallel to the flange F, but deviates by the angle θ. The actual angle θ can be varied in accordance with the width of the line and other factors.

The speed of the spooling head can be constant so that the line is laid as a straight line between the origin O1 and the apex A1, but in certain embodiments, the linear speed of the spooling head optionally reduces as the drum approaches 180°, so that the angle of the line is arcuate and gradually approaches the perpendicular as it nears the 180° point. At the 180° point on the barrel (at the apex A1 on FIG. 3) the line is actually being laid parallel to the flange F.

The first row of the first layer L1R1 is thus laid from left to right between the origin O1 and the 180° point diagonally opposite the origin O1 on the barrel B as the drum 1 rotates from the origin O1 through the first 180°. The linear outward excursion of the spooling head along the threaded spooling bar as the drum rotates between the origin O1 and the 180° point is determined by the programming of the logic device and the pitch of the thread on the bar, and the speed of movement from left to right of the spooling head is typically sufficient to displace the spooling head by a given amount according to the logic device. In this example, the linear axial displacement of the spooling head from the flange at the 180° point (or D180) is around 50 cm.

At this point, the winch drum 1 continues to rotate past 180°, but the linear direction of movement of the spooling head reverses to move in a return excursion from right to left back towards the flange F at slightly reduced speed as compared to the outward excursion between 0° and 180°. Thus the 180° point on the barrel defines an apex A1 in the first row of the line L1R1. The apex A1 can coincide with a radial protrusion such as a boss or a wedge etc on the barrel in order to prevent slippage of the line back towards the flange from the apex, and to maintain the displacement D180 at the apex A1.

The first row L1R1 continues back towards the flange between 180° and 360° until the drum 1 has completed its first rotation and reaches the 360° point as shown in the upper part of FIG. 3. At that point, the spooling head has approached the flange F, but because its return excursion is slower than the outward excursion, the line is not returned precisely to the flange at the 360° point, but is spaced by a distance determined by the difference between the outward and return excursions of the spooling head. In this example, the outward displacement of the spooling head is 50 cm, and its return displacement on its slower return trip is 40 cm, and thus the final displacement from the flange of the second row L1R2 of the line at the 360° point (or D360) is approximately 10 cm. The value of D360 is defined by the difference between the outward and return excursions of the spooling head.

Upon reaching the 360° point, the first row of the first layer L1R1 seamlessly connects with the second row of the first layer L1R2 as shown on the bottom of the representation in FIG. 3. At that point, the direction of movement of the spooling head changes again, to move from left to right in a second outward excursion at the same initial faster rate, in order to lay the second row L1R2 of the first layer parallel to the first row L1R1. The second row L1R2 is laid parallel to the first row L1R1, with a change of direction at the apex Al at 180° from the origin O1 as with the first row L1R1. The return excursion of the spooling head for the second row L1R2 is again slower than the outward excursion, causing an axial displacement of the upper end of the second row L1R2 from the upper end of the first row L1R1 in accordance with the directions of the logic controller. Again the displacement at 360° of the second row L1R2 from the first row L1R1 can be 10 cm in accordance with this example, but can be varied in accordance with other embodiments.

This process continues with the top end of L1R2 merging into the bottom end of L1R3 and so on until the line has been laid onto the outer surface of the drum, and the opposite flange has been reached at the other end of the barrel B. At that position, the line is typically in the configuration shown in FIGS. 4 and 6 with the first layer L1 covering the entire outer surface of the barrel B. Because the rows in the first layer are parallel to one another and bend at the same apex A1, the only gaps on the barrel where no line is laid occur at the ends of the first layer.

When the right hand end of the barrel has been reached and the line is approaching the opposite flange, the second layer L2 is then laid on top of the first layer L1. When the second layer L2 is laid, the drum 1 continues to rotate in the same direction at the same speed, but the movement of the spooling head is reversed, so that when laying the first row of the second layer L2R1, the spooling head commences at the origin O2 (at the same circumferential position as the original O1 for the first layer L1, but adjacent the opposite flange) and moves from right to left in the outward excursion at the first speed, and after passing the apex A2, begins the slower return excursion between 180° and 360°. Thus the first row of the second layer L2R1 merges into the second row of the second layer L2R2 at the 360°/0° point and at an axial position that is displaced by 10 cm from the first row L2R1. Successive rows L2R3 and L2R4 etc of the second layer L2 are spooled on top of the first layer L1 in a similar manner, bending at the apex A2 until the left hand flange is reached by the spooling head.

It will be noted that the whereas first layer L1 originates at the left hand side of the barrel, traverses to the right across the barrel to the apex Al and then returns to the left towards the 360° point, the second layer L2 originates at the right hand end of the barrel B adjacent to the right hand flange, traverses to the left to the apex A2 at the 180° point on the barrel B in its outward excursion, and returns to the right as it approaches the 360° point. Therefore, adjacent layers L1 and L2 are non-parallel to one another, so that the individual rows in the second layer L2 substantially cross over the individual rows in the lower layer L1. Thus, even though the individual rows within each layer are parallel to one another, the individual rows L2 are substantially never parallel to the individual rows in the adjacent lower layer L1, and thus the likelihood of the rows in the upper layer L2 squeezing or biting into the rows in the lower layer L1 is greatly reduced.

Figure 9:
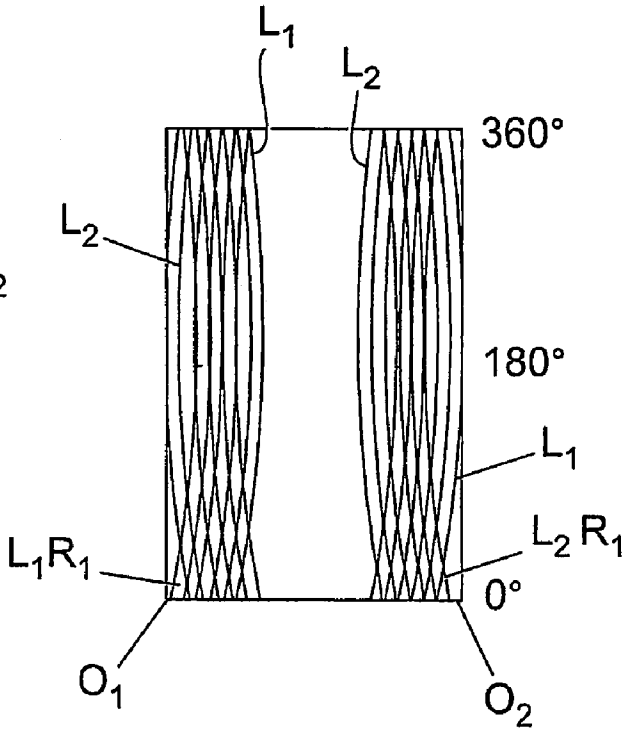
Figure 8:
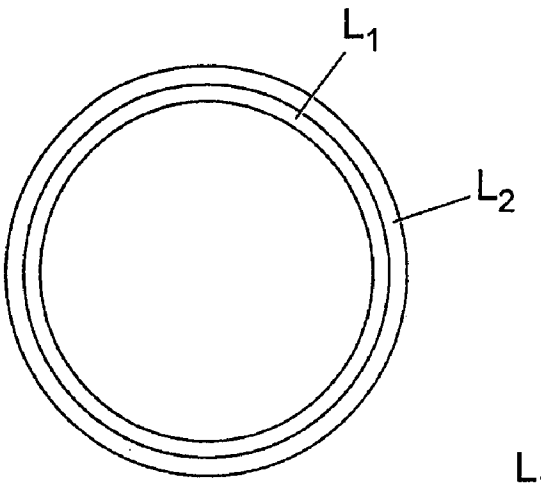
FIG. 8 shows the end view of the FIG. 7 barrel.
Figure 7:
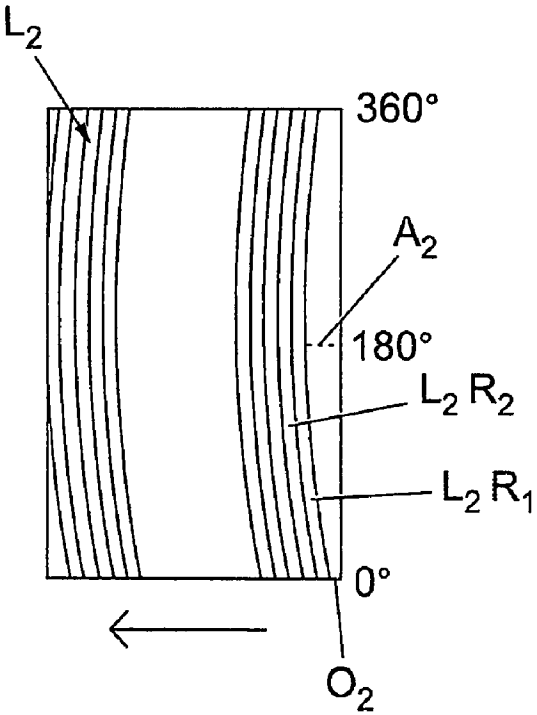
FIG. 7 shows a flat view of the FIG. 4 barrel showing only the second layer being spooled.

The eventual pattern after spooling of the second layer is as shown in FIGS. 8 and 9, with the second layer L2 spooled on top of the first layer L1. FIG. 9 particularly shows the rows in L1 crossing over the rows in L2, thereby substantially preventing biting between layers, while keeping the rows within each layer parallel to one another, thereby conserving space on the drum 1.

Figure 4:
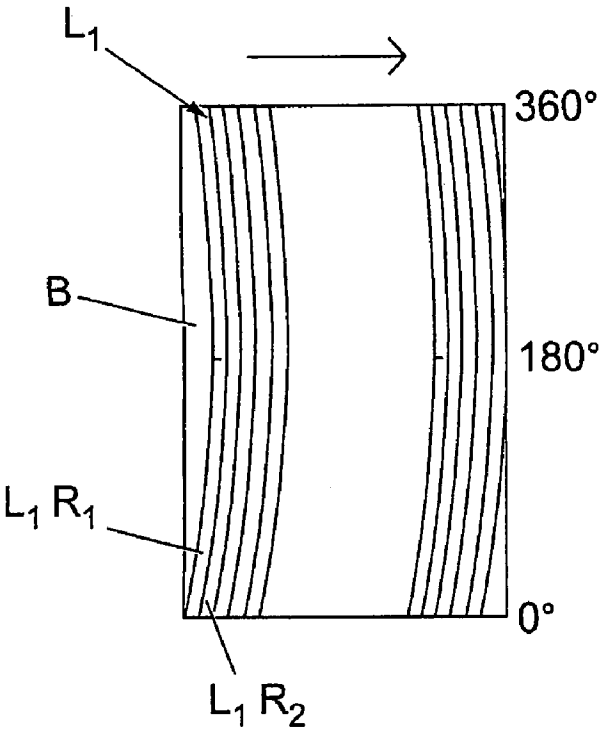
FIG. 4 shows a similar flat view of the first layer of line wound onto the barrel.
Figure 10:
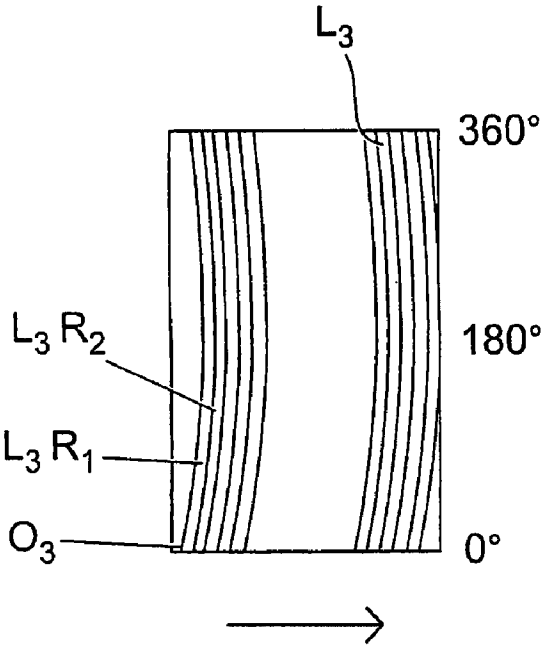
FIG. 10 shows a flat view similar to FIGS. 4 and 7 with the third layer in place.

FIG. 10 shows the third layer L3 being applied from the origin O3 at the bottom left hand corner of FIG. 10 to the top left in a manner similar to the first layer L1 as shown in FIG. 4. The origin O3 of the third layer can be generally coincident with the origin O1 of the first layer.

Figure 12:
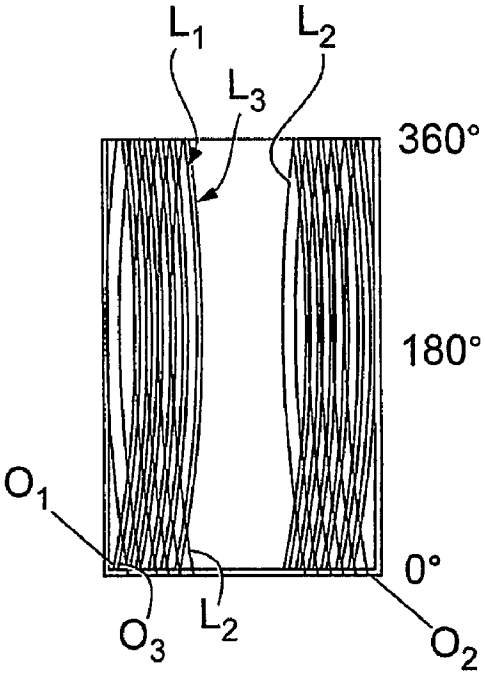
Figure 11:
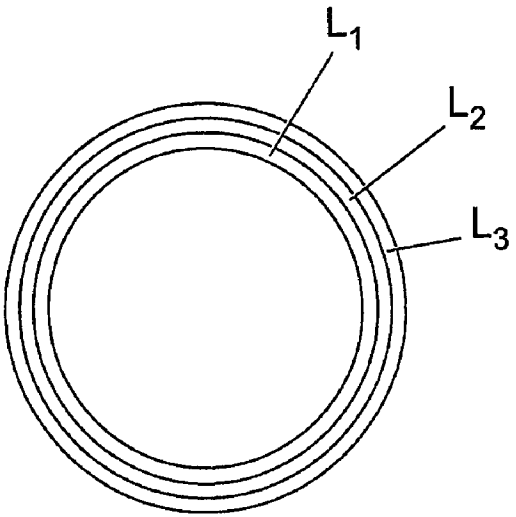
FIG. 11 shows an end view of the FIG. 10 barrel.

As shown in FIG. 12, the third layer L3 overlies the first layer L1, but since the second layer L2 crosses over between both of them, substantially no biting can occur between the layers. The rows in the third layer L3 cross over the rows in the second layer L2 and therefore substantially avoid biting as described above.

It can be seen from FIG. 12 that overlaying each second layer in this manner emphasises the gap that forms at the 180° point on the barrel B. This might in some circumstances tend to create a void into which the line can slip, and while it is satisfactory for each second layer to commence at the same origin, a beneficial effect can sometimes be obtained by a more staggered distribution of the origin of the layers around the circumference of the barrel B.

This can be achieved by a programmed action by the logic controller acting on the spooling head when the spooling head reaches the furthest extent of the barrel B adjacent to the flanges and is about to execute its turn to commence the first row of the next layer. In some embodiments (as shown in the figures) the spooling for the next layer can commence at the same 360°/0° point on the barrel, so that the third layer is superimposed on top of the first layer, and the fourth layer is superimposed on top of the second layer, and so on. However, if the logic controller optionally signals the spooling head to remain axially stationary as the barrel B rotates a short way around its axis (for example, half a turn) the origin of the second layer can be rotationally staggered away from the 360°/0° point before the spooling of the next layer commences. The spooling of the next layer can be carried out in an identical manner to that previously described for the second and third layers, with the sole exception that the origin of the next layer is somewhere between 0° and 360° with respect to the spooling of the previous layer. This "rotational stagger" feature can be introduced between adjacent layers, or more usefully between every second alternate layer in order to stagger the gaps created at the apex of each layer so that none of the gaps are superimposed on gaps in lower layers. Thus more of the space on the drum is taken up with rows of line, and the propensity for formation of deep gaps into which the line can slip is mitigated.

Figure 13:
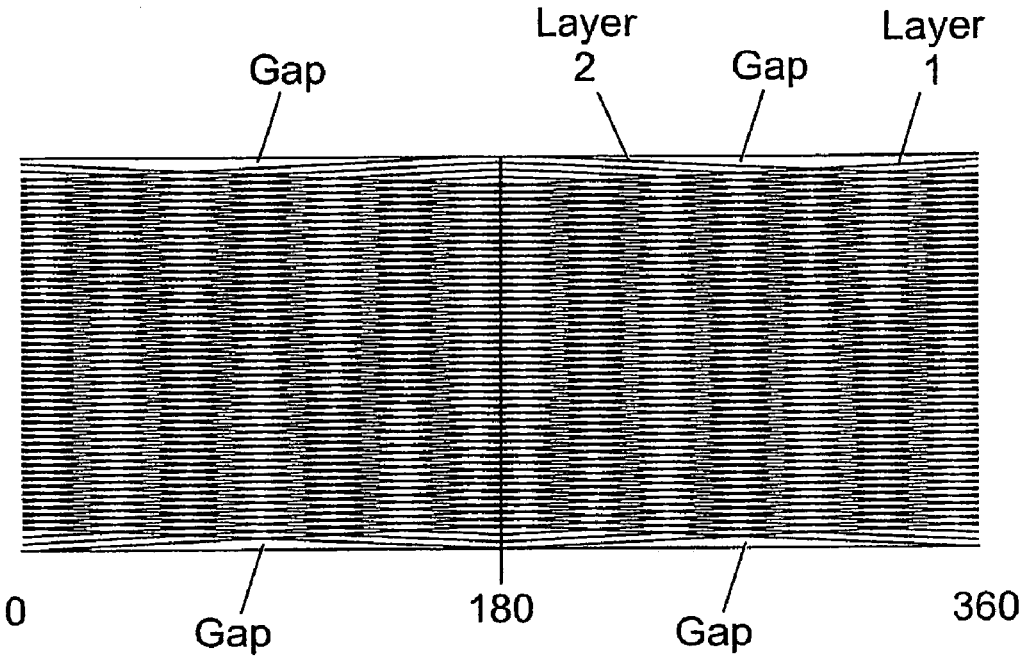

After winding of two layers, the whole barrel has an appearance similar to that shown in FIG. 13, again displayed in a flat rolled out schematic manner. In FIG. 13, the darker first layer is spooled from top left to bottom right, and the lighter coloured layer spooled from bottom left to top right. The gap formed at 180° for the first layer is clearly evident, and the gap formed at the opposite flange for the second layer can also clearly be seen at 180°.

Figure 14:
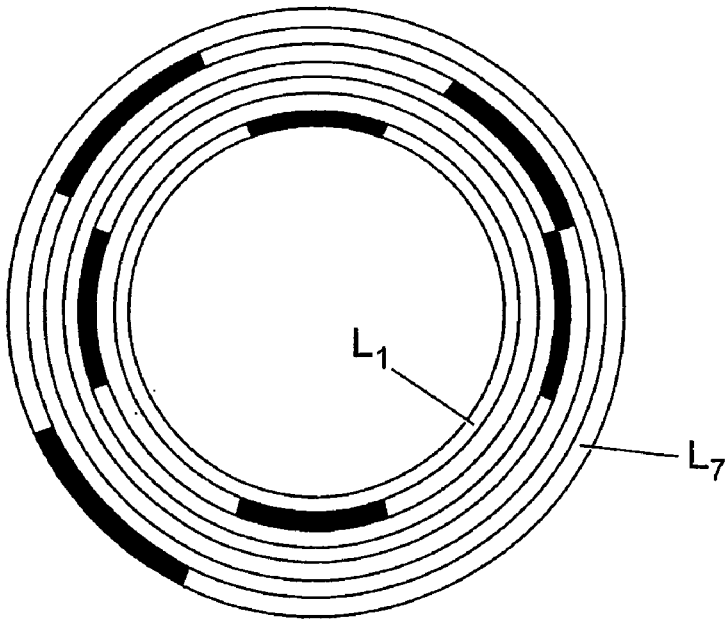

One advantage of staggering the gaps as previously mentioned can be seen from the representation in FIG. 14, illustrating the locations of the gaps in end view after seven layers have been spooled.

Figure 15:
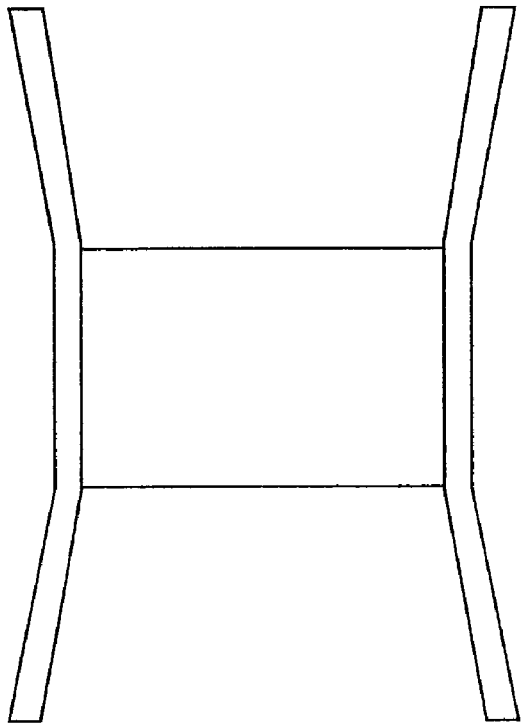
FIG. 15 shows a further embodiment of a winch barrel with flared flanges.
Figure 16:
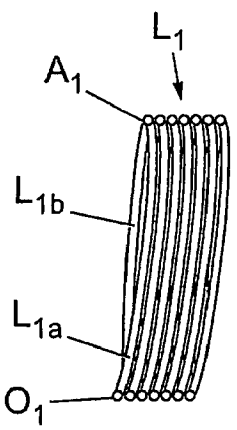
FIG. 16 shows a schematic view of a further embodiment of a method of spooling line with a 7° angle, in which the barrel has been omitted for clarity, and in which the tracks of a 1st layer of line shown.
Figure 17:
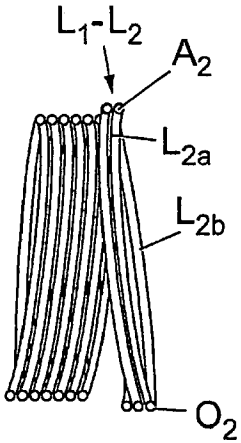
FIGS. 17 shows a schematic view similar to FIG. 16, showing line 1 and the start of a $2^{nd}$ layer of line.
Figure 18:
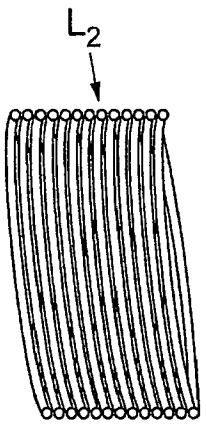
FIGS. 18 shows a schematic view similar to FIG. 16, showing the $2^{nd}$ layer of line.
Figure 19:
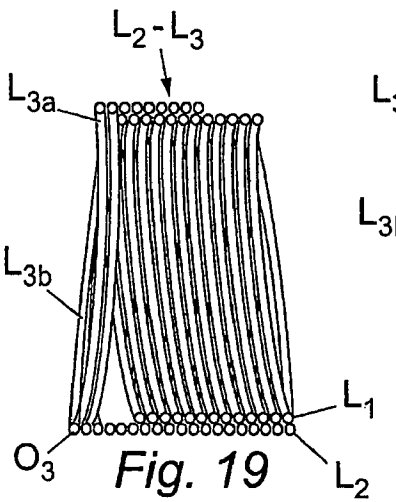
FIG. 19 shows a schematic view similar to FIG. 16, showing line 2 and the start of a $3^{rd}$ layer of line.
Figure 20:
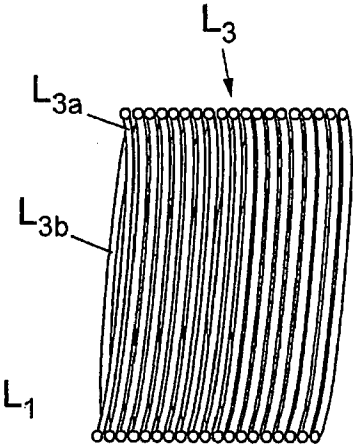
FIG. 20 shows a schematic view similar to FIG. 16, showing the $3^{rd}$ layer of line.
Figure 22:
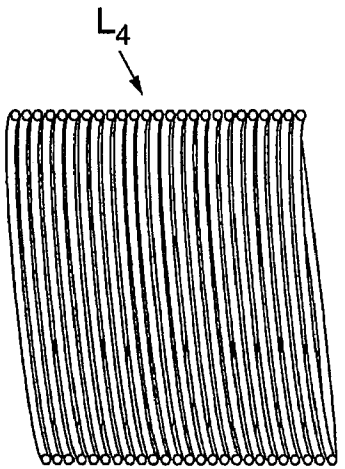
FIG. 22 shows a schematic view similar to FIG. 16, showing the $4^{th}$ layer of line.
Figure 21:
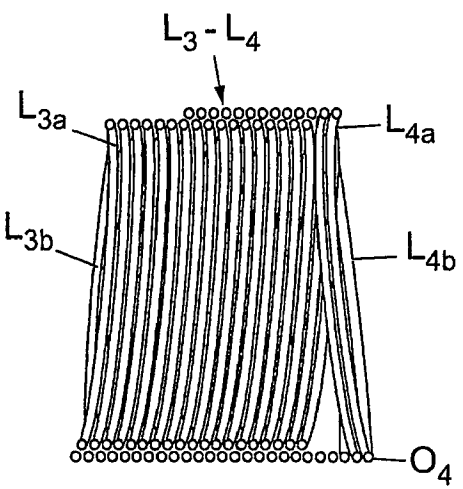
FIG. 21 shows a schematic view similar to FIG. 16, showing line 3 and the start of a $4^{th}$ layer of line.
Figure 23:
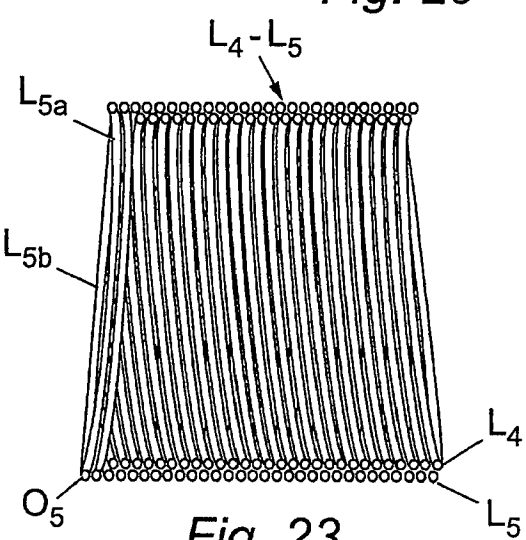
FIG. 23 shows a schematic view similar to FIG. 16, showing line 4 and the start of a $5^{th}$ layer of line.

In some embodiments of the invention, the winch drum 1 can be formed with flared or tapered flanges as shown in FIG. 15. The flare or taper provides more room for the spooling gear to approach the end of the barrel and to spool the first and last rows of each layer as close as possible to the flange without damage or obstruction of the spooling gear or the flange. The taper can also help to prevent wear and tear on the line as it is being spooled on or off the drum.

Embodiments of the invention enable a higher spooling rate (a greater axial displacement of the line per turn) than is common for wire rope, but also enable efficient use of the available space on the barrel. Typically, the spooling rate is at least two times that for a wire line but preferably around four times that for a wire line.

Referring now to FIGS. 16-29, the first layer of line L1 is spooled onto a barrel (omitted for clarity from FIGS. 16-42) from an origin O1 at a notional 0° on the barrel. The FIGS. 16-42 show the front half and the read half of each layer of line, so the origin O1 at the bottom of each of these figures denotes the 0° and 360° positions, and the apex A1 at 180° is shown at the top of the figures. The front half L1*a* of the line is payed out at an initial angle of 7° (bottom left to top right) with respect to the axis of the barrel from the spooling head, which travels from left to right, and which slows at the apex Al at a rotational position of 180° from the origin, to reverse direction and travel at around 7° from top right to bottom left, to spool out the second half L1*b* of the first row. Successive rows of the first layer L1 are spooled on like this. The second later L2 initiates at O2 transitioning from the last row of the first layer L1, and the first half L2*a* spools on from bottom right to top left, changes direction at the 180° apex A2, and the rear half L2*b* is spooled on from top left to bottom right, and so on. The skilled person will note the larger diameter of the subsequent rows from FIGS. 16-42.

Figure 43:
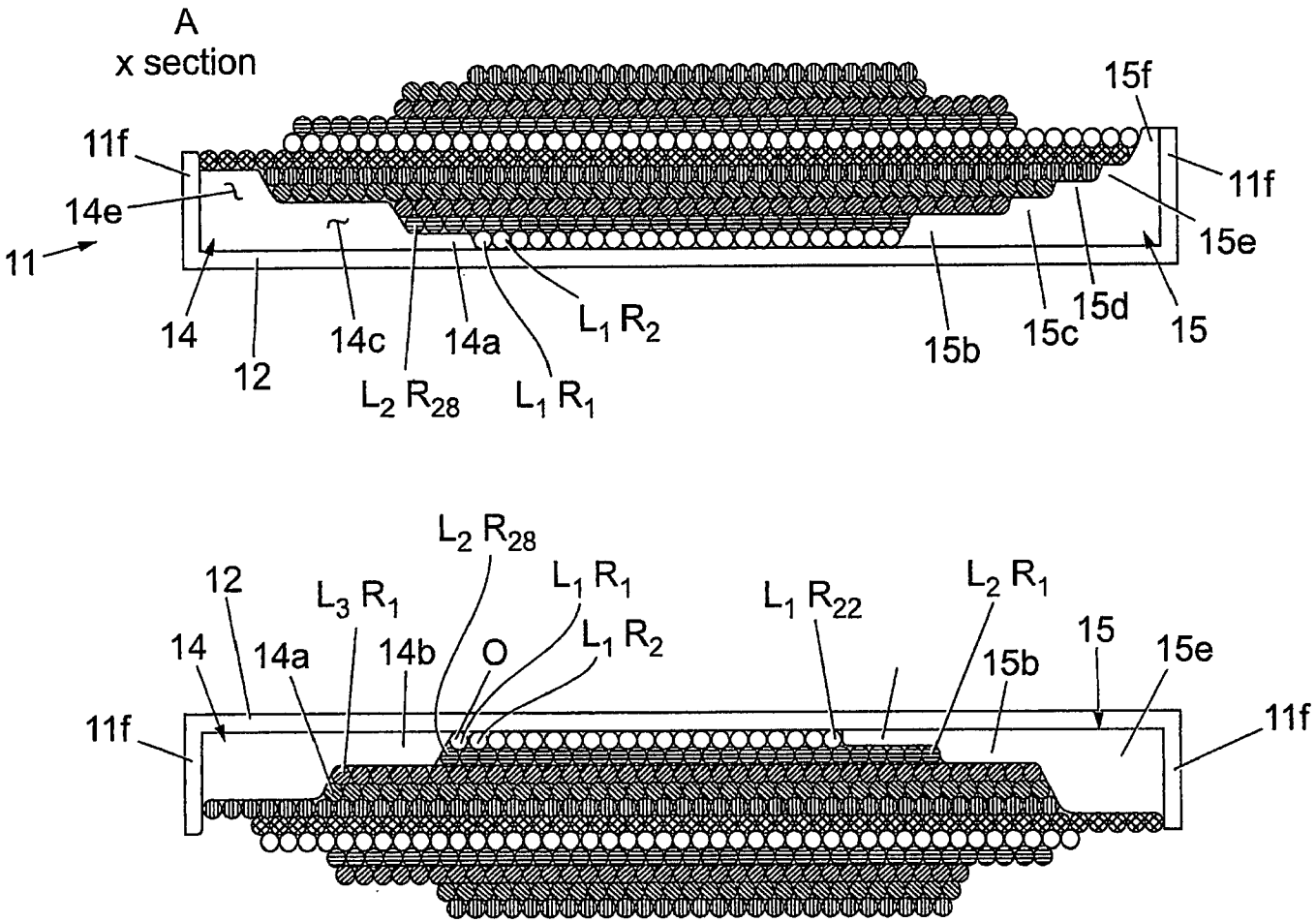
FIG. 43 shows a cross section through a winch barrel with stepped formations to guide the path of the line, and in which different layers of line are shown with different cross-hatched patterns.
Figure 44:
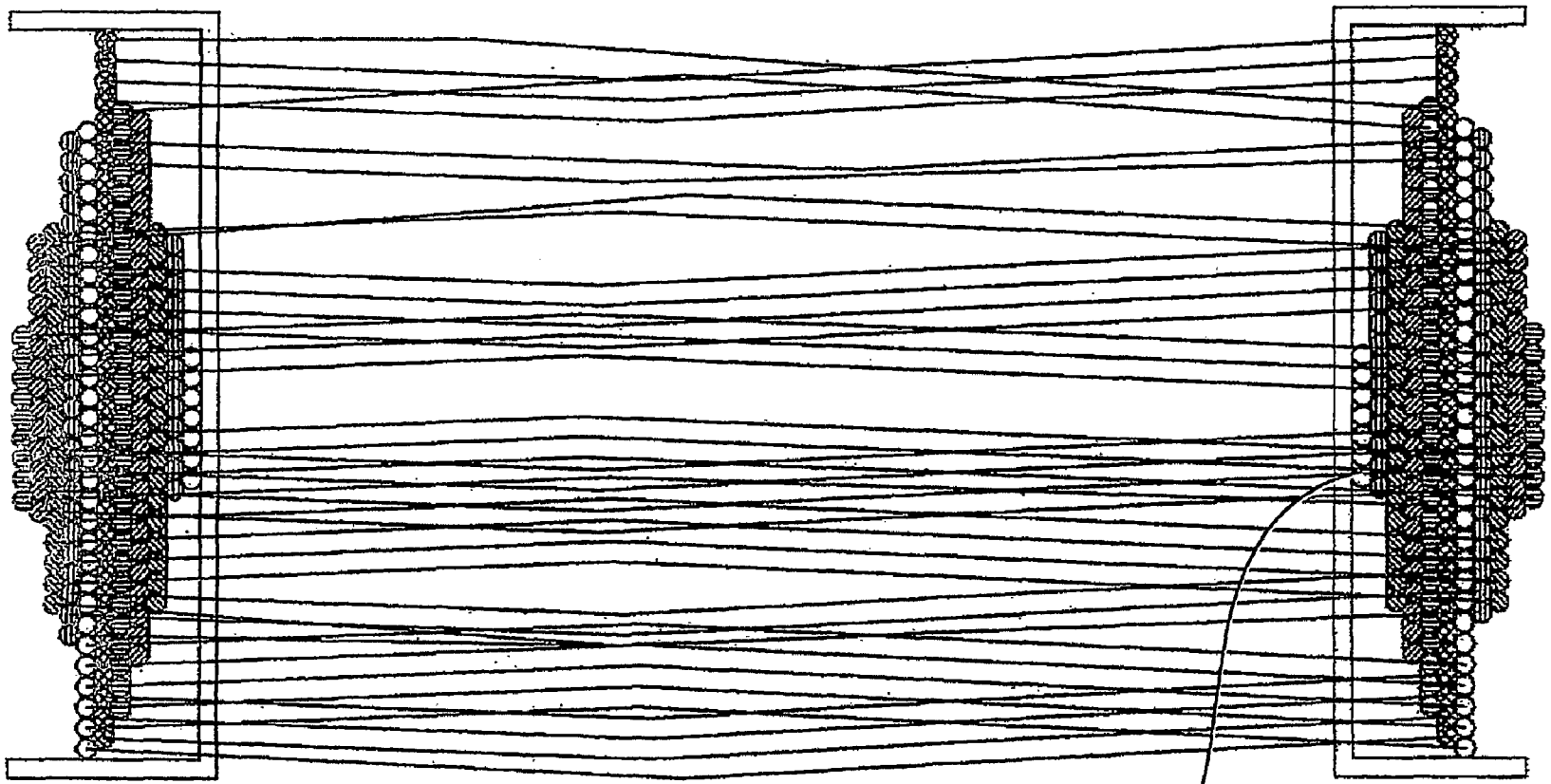
FIG. 44 is a rolled out flat view (similar to the views in FIGS. 4, 7, 10 and 13) of the FIG. 43 barrel.

Referring now to FIGS. 43 and 44, a modified barrel 11 is shown with formations 14 and 15 fixed to the flanges 11F on each side. The formations can be formed from nylon blocks that are bolted to the plain body 12 of the barrel 11. The formations 14 and 15 are asymmetrical with respect to one another, and with respect to their own axes.

Referring to the first formation 14, it comprises a radially innermost first portion 14*a* axially supporting the first layer of line, a second portion 14*b* wider than the first portion 14*a* and axially supporting the first and second layers, a third portion 14*c* wider than the second 14*b*, and axially supporting the second and third layers of line, a fourth portion 14*d* wider than the third and axially supporting the third and fourth layers, and a fifth portion 14*e* wider than the fourth and axially supporting the fourth and fifth layers of line. The sixth layer of line is supported by the flange 11F at the upper portion.

Referring to the first formation 15 on the right hand side of FIG. 43, it comprises a radially innermost first portion 15*a* axially supporting the first layer of line, a second portion 15*b* wider than the first portion 15*a* and axially supporting the first and second layers, a third portion 15*c* wider than the second 15*b*, and axially supporting the second and third layers of line, a fourth portion 15*d* wider than the third and axially supporting the fourth layer, a fifth portion 15*e* wider than the fourth and axially supporting the third, fourth and fifth layers of line, and a sixth portion 15*f* that is wider than the fifth portion and supports the sixth and seventh layers of line.

The different portions of the formations 14 and 15 merge into one another.

Referring now to FIG. 43 starting from the origin O, the first layer (clear circles) is spooled onto the body 12 from lower left to top right, with the radially innermost side of the wall portion 14*a* radially supporting the angled path of the line from 0 to 180°. At the 180° point of L1R1, the axial direction of the spooling head changes and starts moving from right to left instead of left to right, thereby spooling the second half from 180° to 360/0° of L1R1 onto the body 12 (which can optionally be grooved) in the opposite direction from the first half (from 0 to 180°). When the spooling head reaches the 360/0° point once again and is ready to begin the first half of L1R2, it resumes its original left to right axial direction. This continues until to the end of the first layer when the last row L1R22 runs up a ramp onto the top face of 15*a* and becomes L2R1, which is guided from right to left in the first half of its spooling by the wall portion 15*b*. Likewise, the last row of the second layer L2R28 rides up onto the upper face of wall portion 14*a* and becomes the first row of the third layer L3R1, axially supported by the wall portion 14*d*. Spooling continues in this manner until the flanges 11F are reached, at which point the layers are spooled on top of one another to the maximum extent possible, without any portions of adjacent layers running in parallel directions, as indicated in previous embodiments. FIG. 44 shows a flattened (schematic) view of the FIG. 43 drum (with fewer rows). Note that the lines connecting the rows in each side of FIG. 44 are straight to show the initial angle of the line, but in fact these grooves and wall portions that guide the paths of the individual rows of line are arcuate.

Figure 45:
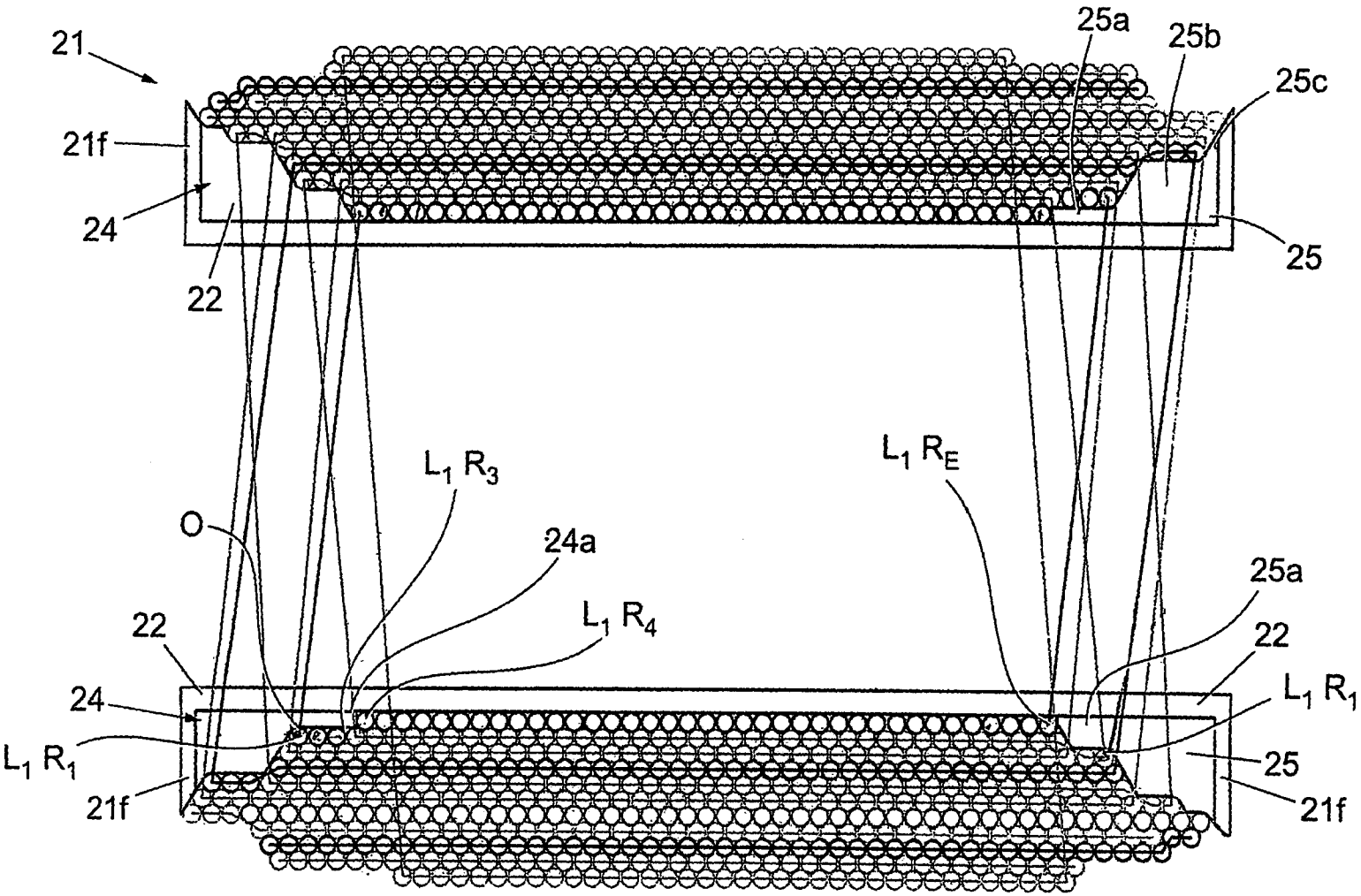
FIG. 45 is a cross sectional view of a further winch barrel with a winding pattern in which a single excursion of the spooling head spools more than one layer of line onto the barrel, and in which lines connecting the two halves of the barrel show the relationships between the inner layers of line.
Figure 46:
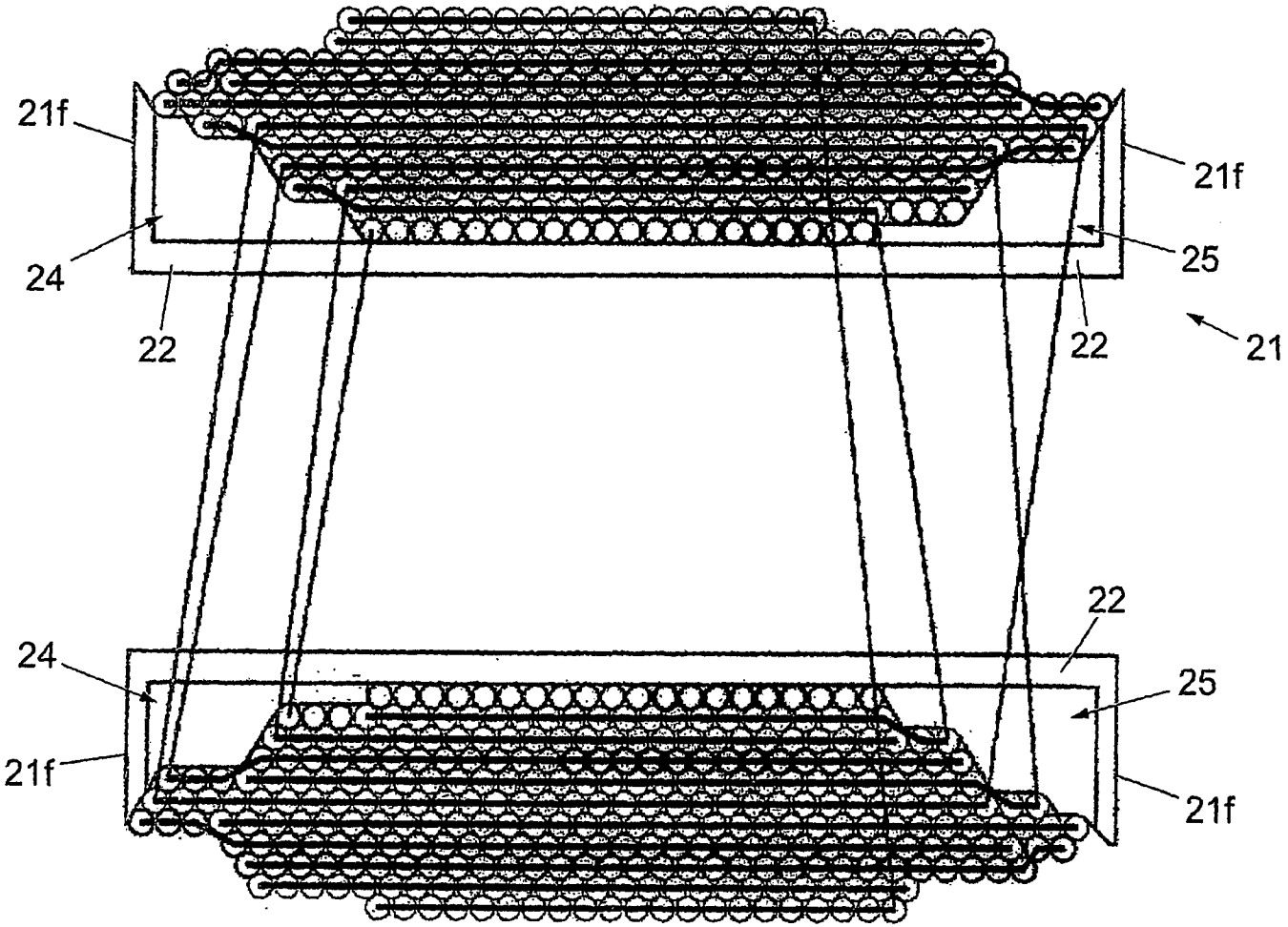
FIG. 46 is a view similar to FIG. 45, but in which the lines connecting the two halves of the barrel show the relationship between the outer layers of line.
Figure 47:
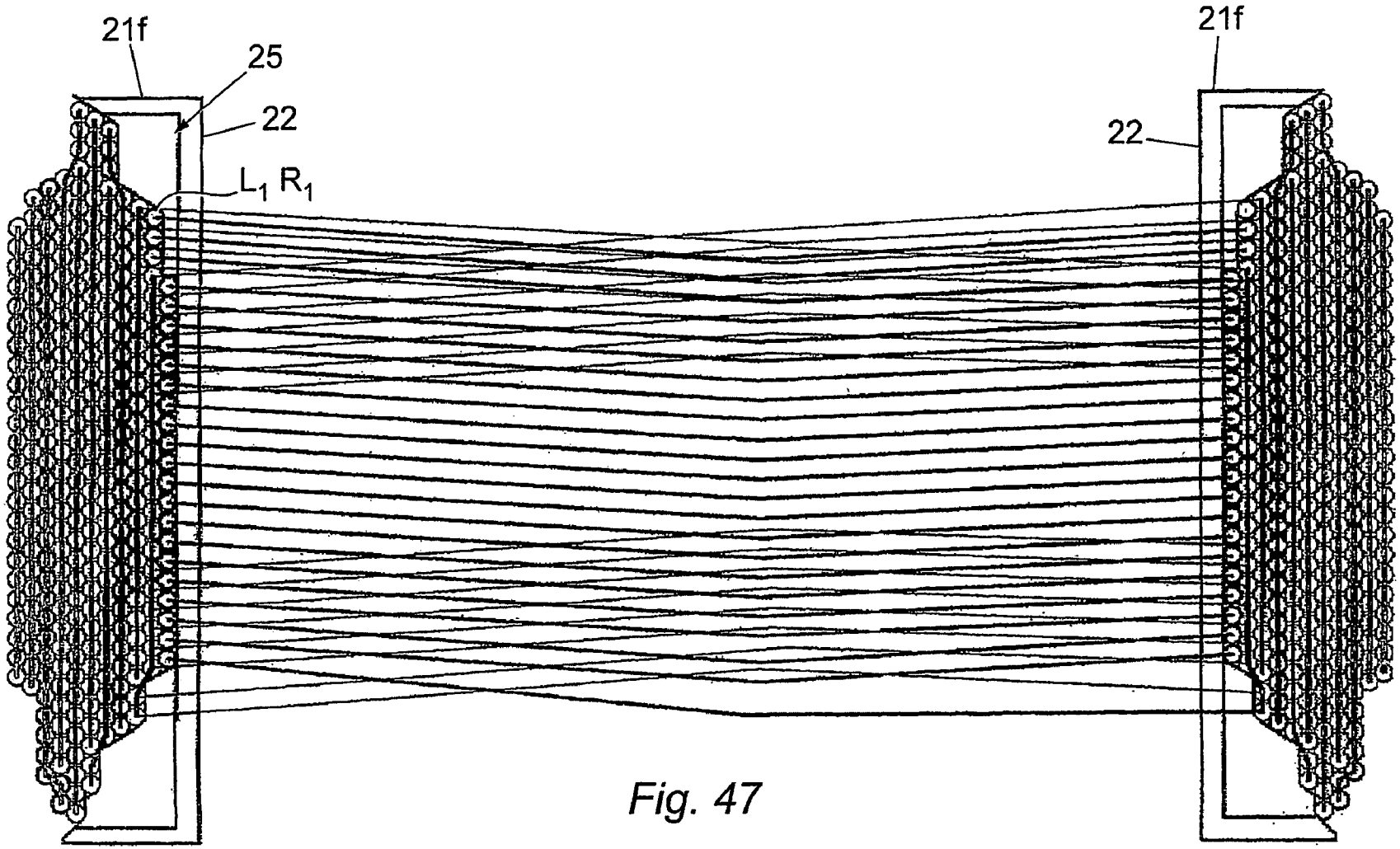
FIG. 47 is a rolled out flat view (similar to the views in FIGS. 4, 7, 10 and 13) of the FIG. 45 barrel.

Referring now to FIGS. 45 and 46, a variation is described in which the first layer L1 is spooled onto the barrel 21 at more than one level. This allows more compact barrels with axially shorter lengths and more axially compact formations 24 and 25 to guide the line. The origin O of the barrel 21 is shown on the upper surface of the first portion 24*a* of the left hand formation 24, rather than on the body 22 of the barrel 21. The first layer L1 fully descends to the body 22 at the third and fourth rows L1R3 and L1 R4, and then run along the body 22 until shortly before the end row L1RE the first layer starts to rise up onto the radially outermost surface of the first portion of the right hand formation 25*a*. The second layer L2R1 then begins on the upper surface of wall portion 25*a*. Lines connecting the sequential rows of each layer are shown on FIG. 45, thereby demonstrating how to traverse between radially different levels on the barrel 21 in a single excursion of the spooling head. FIG. 46 is a similar view identical in structure to FIG. 45, but showing the interconnections between the rows in the outer layers of the line. FIG. 47 shows a flat view with the same detail, and lines showing the interconnections between each row.

Figure 48:
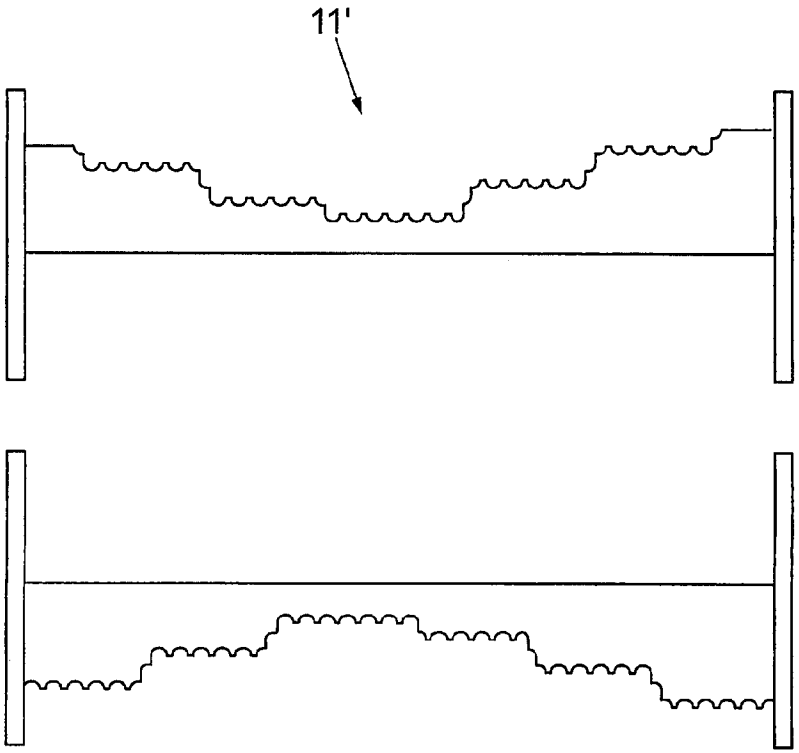
FIG. 48 shows a sectional view of a further embodiment of a winch drum similar to FIG. 43, but with grooves on the surface of the barrel.

FIG. 48 shows a further embodiment of a winch drum barrel 11' similar to the barrel 11 in the FIG. 43 embodiment, but in which much of the surface of the barrel is grooved to accept and guide the initial layer of the line.

Referring now to FIGS. 49-53, a further embodiment of a winch drum 31 is shown, which is similar to the FIG. 43 winch drum 11. The winch drum 31 has flanges 31*a* and 31*b*, an origin O for fastening the line, and a grooved surface on the radially innermost part of the barrel to guide the inner layer of line. The winch drum 31 has walls 34 and 35, similar to the walls 14 and 15 of the drum 11.

Figure 49:
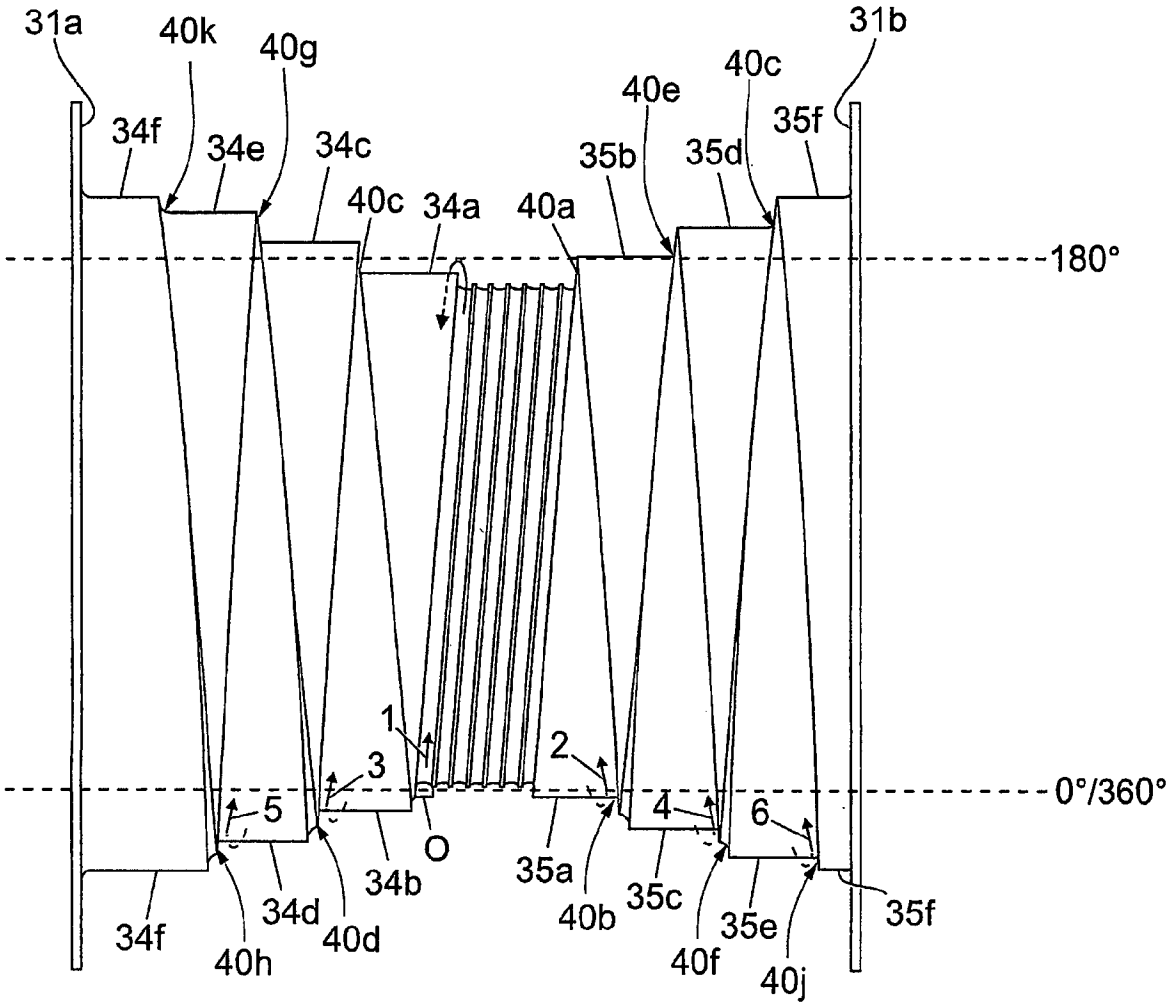
FIG. 49 shows a front view of a further design of winch drum barrel similar to FIG. 43.
Figure 50:
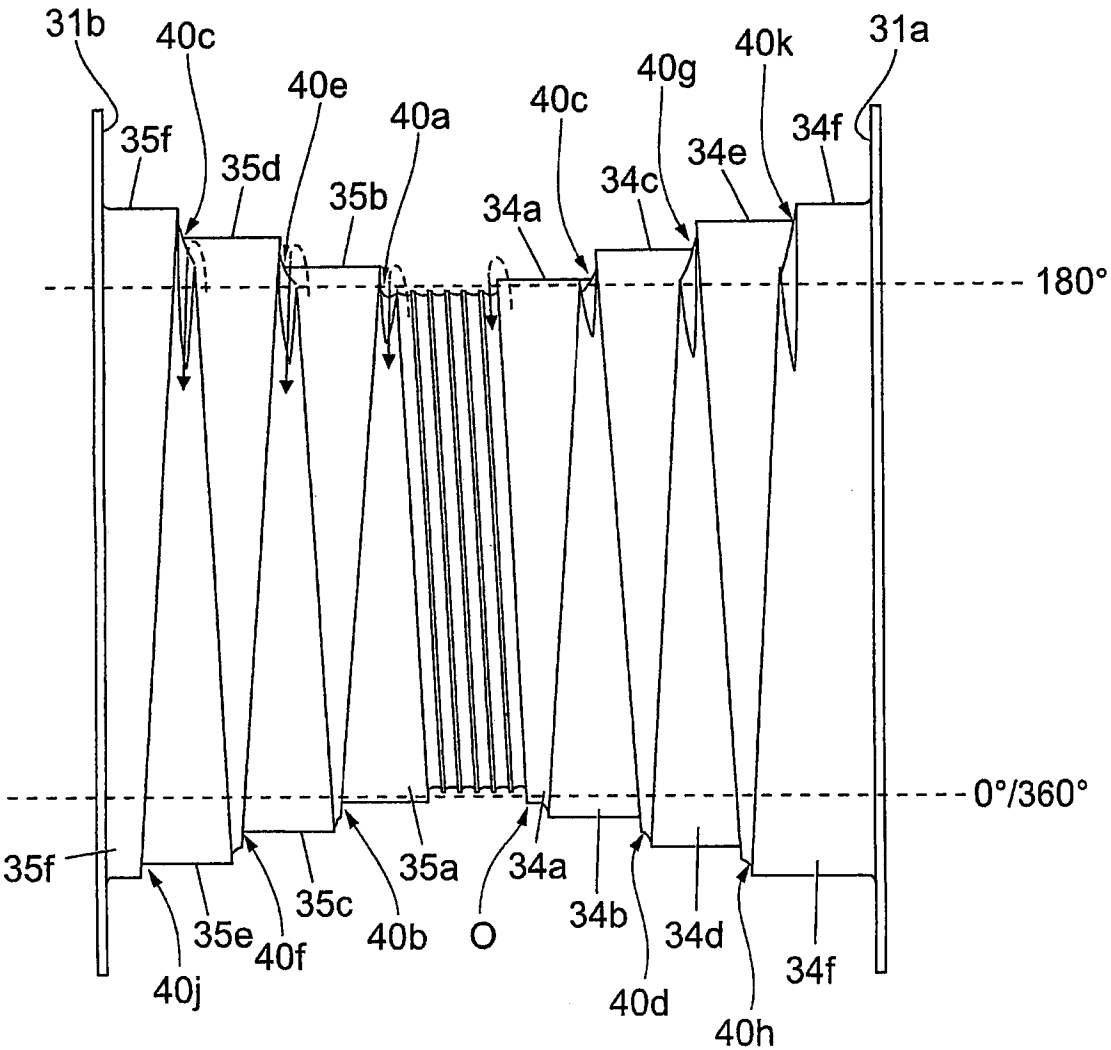
FIG. 50 shows the back view (from the other side) of the FIG. 49 barrel.
Figure 51:
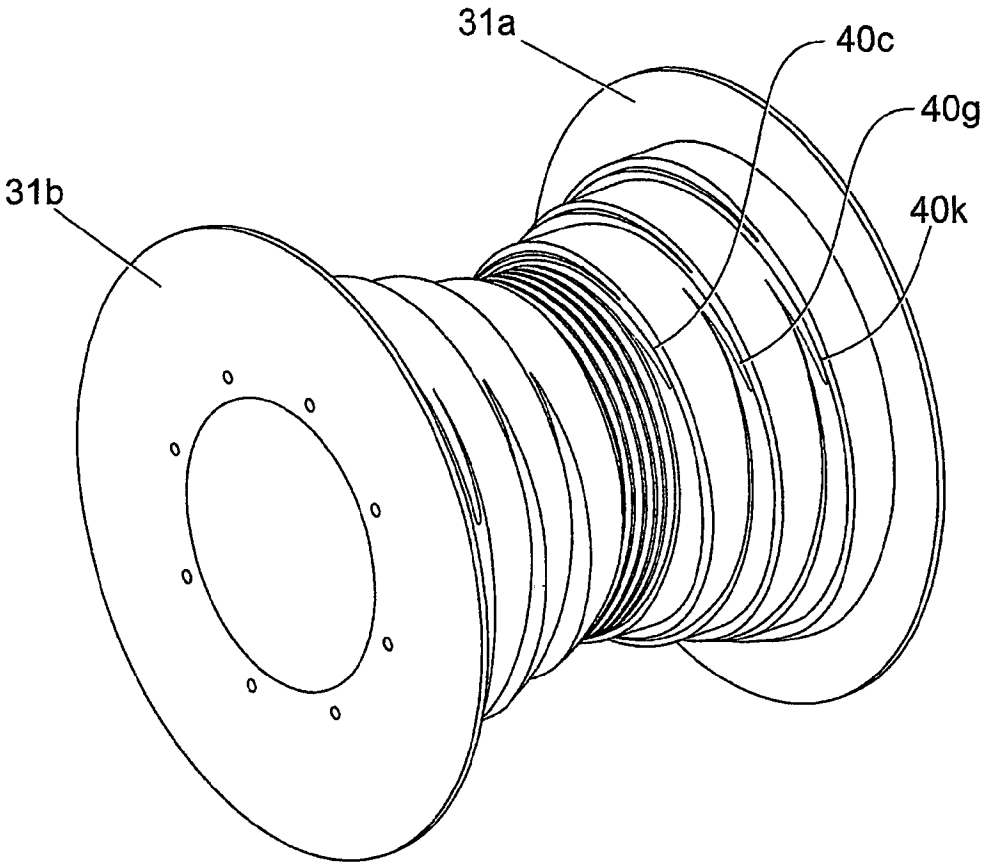
FIG. 51 shows a perspective view of the FIG. 49 barrel from one side and the back.
Figure 52:
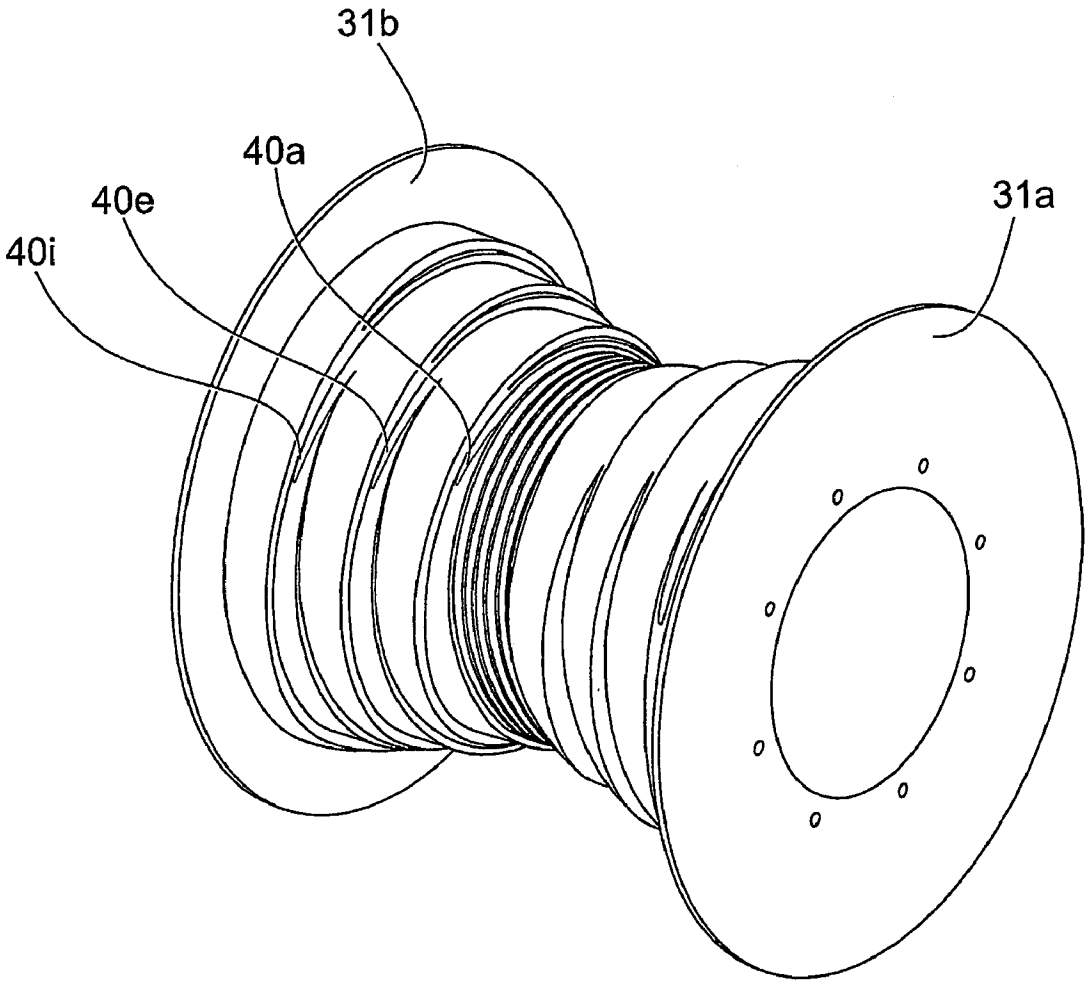
FIG. 52 shows a perspective view of the FIG. 49 barrel from the other side and the back.

Starting from the origin O the line is spooled up the front surface shown in FIG. 49 between 0 to 180° from the flange 31*a* towards the flange 31*b* as shown by the arrow, guided by the grooves and by the spooling head. At the 180° stage at the top of the view shown in FIG. 49, the groove (and the spooling head) changes direction and the back half of the groove (shown in FIG. 50) guides the line (along with the spooling head) in the opposite direction from flange 31*b* towards 31*a*. The initial row of line is guided by the side face of the wall 34*a*. Spooling continues with the change in direction each revolution of the barrel until the line has been spooled onto the whole of the grooved inner section, at which point the line has reached point 40*a* on the 180° line. At point 40*a* there is a groove at the commencement of a ramped wall 35*a*, which rises radially outward from the level of the inner grooved section. The line is guided up the ramped wall by the groove at 40*a*, but despite the fact that it has reached the 180° line it does not change its direction like previous rows, but instead maintains its direction from 31*a* towards 31*b*, guided by the spooling head and by the side face of the wall 35*b*. The line is spooled down the back face (shown in FIG. 50) until it reaches the 360/0° point at 40*b* at which point, the line changes direction guided by the spooling head and by the side face of the wall 35*b* to travel away from flange 31*b* towards 31*a*, in the first row of the second layer.

The second layer is thereby initiated in an opposite direction (31*b* to 31*a*) as compared to the first layer (31*a* to 31*b*). Likewise the rear half of the second layer is set at an opposite angle to the rear half of the first layer. The second layer is wound over the wall 35*a* and the first layer in the same direction (31*b* to 31*a*) until the line reaches point 40*c* at the 180° line, at which point the line engages a groove and rides up onto ramped wall portion 35*b*, which rises up out of the previous layer in a similar manner to ramped wall 35*a*. The line is guided axially against the side face of wall portion 35*c* down the back face of the barrel, in the same direction (31*b* to 31*a*) until it reaches the 360/0° point at 40*d*. At 40*d*, the line changes direction guided by the spooling head and by the side face of the wall 34*c* to travel away from flange 31*a* towards 31*b*, in the first row of the third layer.

Note that the third layer is also initiated in an opposite direction (31*a* to 31*b*) as compared to the second layer (31*b* to 31*a*) and is spooled in the same direction as the first layer. The third layer is wound over the top face of the wall 34*b* and over the second layer in the same direction (31*a* to 31*b*) until the line reaches point 40*e* at the 180° line, at which point the line engages a groove and rides up onto ramped wall portion 35*c*, guided against the side face of wall portion 35*d* down the back face of the barrel, in the same direction (31*a* to 31*b*) until it reaches the 360/0° point at 40*f* at which point, the line changes direction guided by the spooling head and by the side face of the wall 35*d* to travel away from flange 31*b* towards 31*a*, in the first row of the fourth layer.

Thus the fourth layer is thereby initiated in an opposite direction (31*b* to 31*a*) as compared to the third and first layers (31*a* to 31*b*) and is spooled in the same direction as the second layer. The fourth layer is wound over the top of the wall 35*c* and over the third layer in the same direction (31*b* to 31*a*) until the line reaches point 40*g* at the 180° line, at which point the line engages a groove and rides up onto ramped wall portion 34*d*, guided against the side face of wall portion 34*e* down the back face of the barrel, in the same direction (31*b* to 31*a*) until it reaches the 360/0° point at 40*h* at which point, the line changes direction guided by the spooling head and by the side face of the wall 35*d* to travel away from flange 31*a* towards 31*b*, in the first row of the fifth layer.

As before, the fifth layer is spooled onto the barrel in the opposite direction (31*a* to 31*b*) as compared to the even layers (31*b* to 31*a*) and is spooled in the same direction as the third and first layers. The fifth layer is wound over the top of the wall 34*d* and over the top of the fourth layer in the same direction (31*a* to 31*b*) until the line reaches point 40*i* at the 180° line, at which point the line engages a groove and rides up onto ramped wall portion 35*e*, guided against the side face of wall portion 35*f* down the back face of the barrel, in the same direction (31*a* to 31*b*) until it reaches the 360/0° point at 40*j*, at which point, the line changes direction guided by the spooling head and by the side face of the wall 35*f* to travel away from flange 31*b* towards 31*a*, in the first row of the sixth layer.

Figure 53:
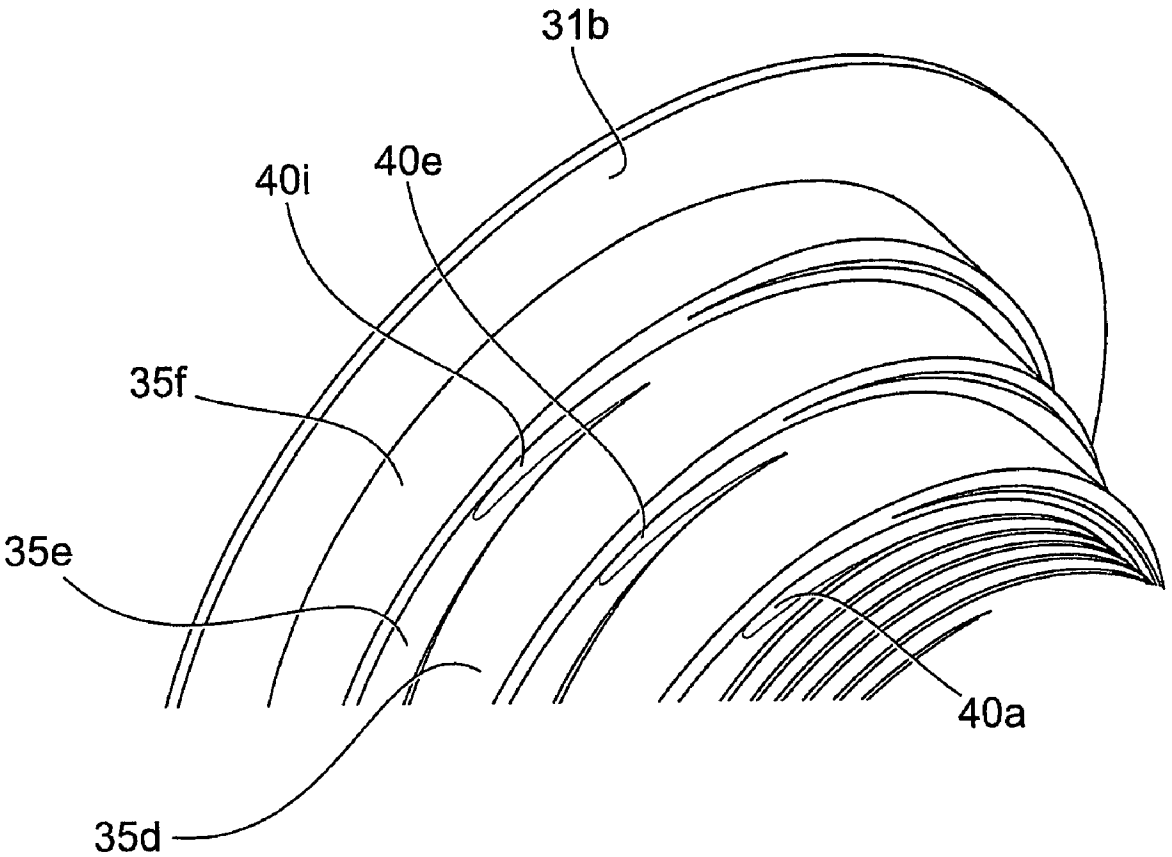
FIG. 53 shows close up perspective view of a flange of the FIG. 48 barrel.

Finally, the sixth layer is spooled onto the barrel in the opposite direction (31*b* to 31*a*) as compared to the odd layers (31*a* to 31*b*) and is spooled in the same direction as the second and fourth layers. The sixth layer is wound over the top of the wall 34*e* and over the top of the fifth layer in the same direction (31*b* to 31*a*) until the line reaches point 40*k* at the 180° line, at which point the line engages a groove and rides up onto ramped wall portion 34*f*. At this point the options for spooling the line are various. In some embodiments, the line can be guided by the groove and/or the spooling head to the side of the flange 31*a*, and the last layer spooled as normal from the flange 31*a* to the flange 31*b*. In some embodiments, the sixth layer can be axially shortened, to be spooled on top of earlier layers, without substantially engaging the walls 34 and 35. Note that the even layers of line are laid in the same direction, as are the odd layers, but that the respective halves of the odd and even layers are laid in opposite directions, so that each radially adjacent row is non-parallel to its neighbouring row above and below it. Also, note that the start points of the ramps and grooves are circumferentially displaced (e.g. by around 4°) around the surface of the barrel, so that the even (and odd) layers do not start at the same point. This helps to evenly distribute the line on the barrel surface. Each of the walls is typically ramped and arises out of the plane of the previous wall. Thus, for example as best shown in FIG. 53, wall 35*e* typically rises gradually out of the plane of wall 35*d*. The radial surfaces of each of the ramps typically start and end on a tangent to ease the change in direction and radial height of the line at these points.

Figure 54:
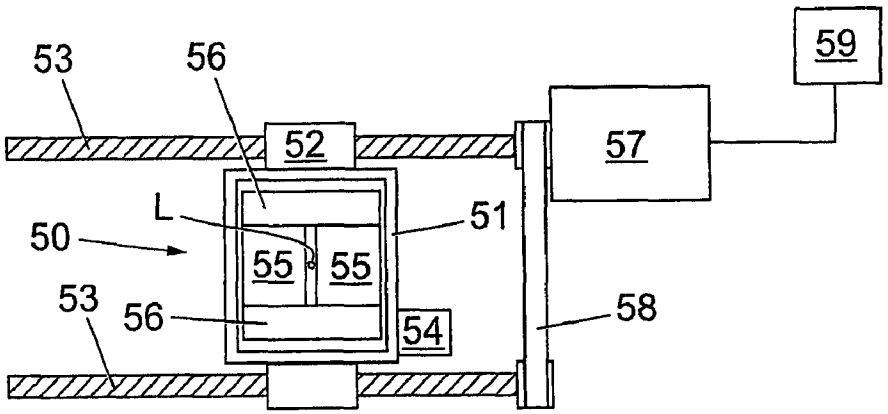
FIGS. 54 and 55 illustrate a first optional embodiment for the spooling head.
Figure 55:
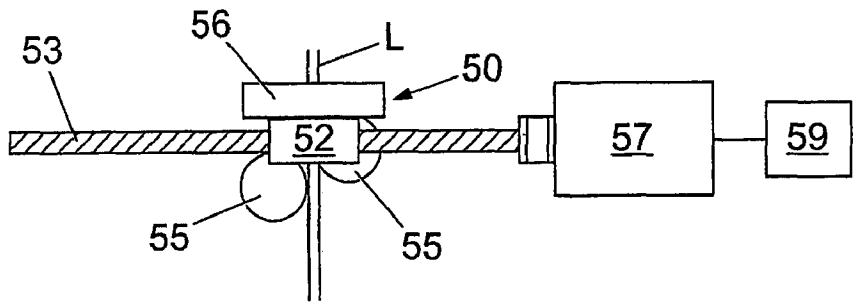

FIGS. 54 and 55 show a first option for the spooling head 50. The spooling head 50 comprises a roller cage 51 (not shown for clarity in FIG. 55) having a threaded traveller 52 (such as a captive nut) on each end, with each traveller 52 engaging a threaded bar 53 driven by a motor 57 and belt 58. The motor can be electric, and its speed and direction can be controlled by an electronic processor 59. The roller cage 51 carries a pair of horizontal rollers 55 and a pair of vertical rollers 56, which together surround and guide a line L. The vertical and horizontal rollers can optionally be staggered or spaced apart from one another in order to permit easy passage of thicker portions of the line L, such as might occur in a splice. The motor 57 drives the bars (one directly, and one through the belt 58) in accordance with signals delivered from the processor 59. The threaded travellers 52 move axially along the rotating bars 53, moving the spooling head 50 axially with respect to the various drum barrels in accordance with the signals from the processor 59.

Figure 56:
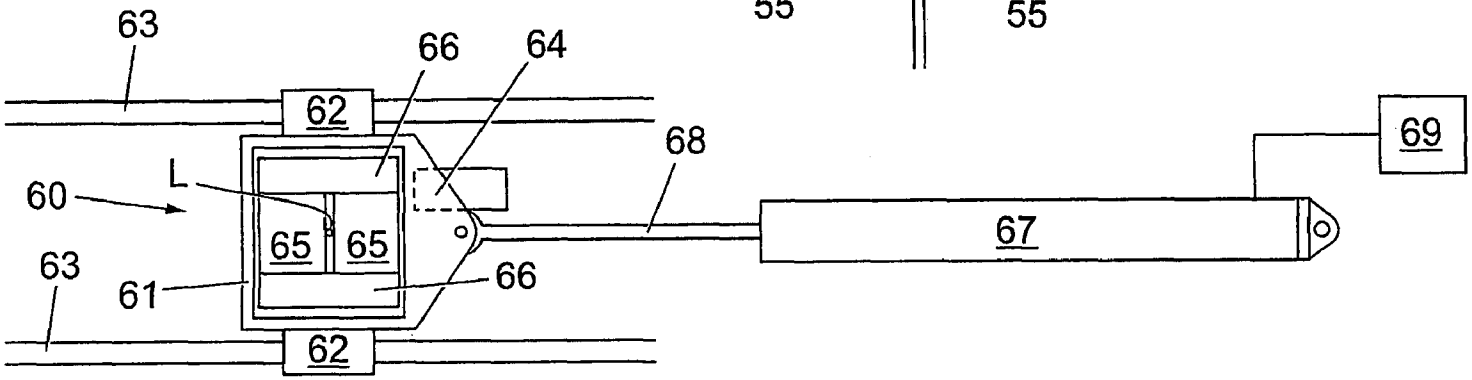
FIG. 56 illustrates a second optional embodiment for the spooling head.

FIG. 56 shows an alternative design of spooling head 60 similar to the head 50, with a roller cage 61, travellers 62, bars 63, and rollers 65 and 66, except that the bars and the travellers 62 are smooth and slide relative to one another. The head 60 is driven by a hydraulic piston 68 urged from a cylinder 67 in accordance with signals from a processor 69.

The rollers 65 and 66 can optionally be staggered from one another in different planes, so that they can be spaced apart by a greater distance than the diameter of the line, but can still engage each side of the line, as shown with respect to the horizontal rollers 65. This allows discontinuities of line diameter to pass through the spooling head without catching the rollers. Optionally the roller cage can permit slight radial movement of the rollers away from the line (e.g. in tracks) to accommodate such bumps, so that the discontinuities such as splices or knots pass through the roller cage by moving between the rollers, or by moving them apart from one another slightly. The roller head can optionally incorporate sensor devices 54 and 64 that feed back to the processor 59, 69, and which detect bumps in the line such as splices etc. When a bump is detected at the spooling head before it is spooled onto the barrel, the spooling head can optionally stop spooling to allow optimal placement of the splice etc, or can automatically move axially to a location that will spool the splice onto the barrel in a recessed area of the line on the barrel, for example circumferentially in between two turning points 40 near to a flange, so that the discontinuity of the line diameter caused by the splice has a minimal effect on the layering of line onto the barrel, which remains as even as possible.

Modifications and improvements can be incorporated without departing from the scope of the invention.

The invention claimed is:

1. A winch drum assembly having a barrel adapted to receive a line, and having a spooling device for guiding the line onto the barrel as the barrel and the spooling device rotate relative to one another, such that the line is spooled onto the barrel at a point that moves axially with respect to the barrel, and wherein the axial direction of the line spooled onto the barrel is adapted to change at least once per revolution of the barrel with respect to the spooling device, such that the line is spooled onto the barrel in a first axial direction when the barrel is in its first half cycle between 0° and 180°, and the line is spooled onto the barrel in a second axial direction which is opposite to the first axial direction when the barrel is in the second half of the cycle of the barrel between 180° and 360°, and wherein axially adjacent rows of line are spooled on the barrel parallel to one another.

2. A winch drum assembly as claimed in claim 1, in which the spooling device comprises a spooling head that receives the line and moves axially with respect to the barrel to guide the feed point of the line along the axis of the barrel as the barrel rotates, and wherein the axial direction of movement of the spooling head is adapted to reverse at least once per revolution of the barrel with respect to the spooling device.

3. A winch drum assembly as claimed in claim 2, in which the spooling head is mounted on a threaded bar that is driven in rotation by a motor, and wherein the speed and direction of the motor is controlled electronically.

4. A winch drum assembly as claimed in claim 2, in which the spooling head is driven axially by a hydraulic piston and cylinder arrangement.

5. A winch drum assembly as claimed in claim 1, in which layers of line wound onto the barrel are substantially non-parallel to the layers immediately above and below them.

6. A winch drum assembly as claimed in claim 1, including a guide device comprising grooves formed in or on the barrel that guide initial layers of the line into selected orientations, directions or locations as it is wound onto the barrel.

7. A winch drum assembly as claimed in claim 6, in which the guide device comprises at least one radial protrusion located on the barrel's outer surface at a position which in use corresponds with locations at which the line changes direction on the barrel, so that the line bends around the radial protrusions as it changes direction.

8. A winch drum assembly as claimed in claim 7, in which the radial projection comprises a wall.

9. A winch drum assembly as claimed in claim 8, in which the wall is perpendicular to the axis of rotation of the barrel.

10. A winch drum assembly as claimed in claim 9, in which the wall has at least one stepped portion.

11. A winch drum assembly as claimed in claim 8, in which the radial dimensions of the wall are similar to the line thickness, or are multiples thereof.

12. A winch drum assembly as claimed in claim 1, in which the guide means comprises at least one ramp formed on the barrel adapted to change the radial position of the line as it is wound onto the barrel.

13. A winch drum assembly as claimed in claim 12, in which the at least one ramp comprises a groove to guide the position of the line on the ramp.

14. A winch drum assembly as claimed in claim 1, wherein the line comprises a high strength fibre rope with a capacity of more than 1000 kg.

15. A winch drum assembly as claimed in claim 1, in which radially adjacent layers of line are laid from opposing ends of the barrel.

16. A winch drum assembly having a barrel adapted to receive a line, and having a spooling device for guiding the line onto the barrel as the barrel and the spooling device rotate relative to one another, such that the line is spooled onto the barrel at a point that moves axially with respect to the barrel, and wherein the axial direction of the line spooled onto the barrel is adapted to change at least once per revolution of the barrel with respect to the spooling device, in which the spooling device is configured to guide the line on an outward excursion in a first axial direction, to reverse the direction of spooling, and to guide the line on a return excursion in a second axial direction which is opposite to the first axial direction, and in which the axial distance of the return excursion is less than the axial distance of the outward excursion.

17. A winch drum assembly as claimed in claim 16, in which the spooling device is configured to remain axially stationary between the outward and return excursions while the barrel is rotating, thereby circumferentially offsetting the origins of radially adjacent layers on the barrel.

18. A method of spooling a line onto a barrel of a winch, the method comprising guiding the line onto the barrel by means of a spooling device, wherein the spooling device and the barrel rotate relative to one another during spooling of the line onto the barrel, wherein the spooling device causes the line to move axially with respect to the barrel as the barrel rotates, and wherein the spooling device causes the line to change axial direction of spooling at least once per revolution of the barrel relative to the spooling device, such that the line is spooled onto the barrel in a first axial direction when the barrel is in its first half cycle between 0° and 180°, and the line is spooled onto the barrel in a second axial direction which is opposite to the first axial direction when the barrel is in the second half of the cycle of the barrel between 180° and 360°, and wherein axially adjacent rows of line are spooled on the barrel parallel to one another.

19. A method as claimed in claim 18, wherein the spooling device comprises a spooling head, and wherein the line is guided onto the rotating barrel through the spooling head, which moves axially with respect to the barrel as the barrel rotates, and wherein the spooling head reverses axial direction at least once per revolution of the barrel thereby reversing the axial direction of line spooled onto the barrel.

20. A method as claimed in claim 19, in which a single excursion of the spooling head in a single direction spools line onto more than one layer of the barrel.

21. A method as claimed in claim 18, in which the axial direction of the line changes twice in each rotation of the barrel.

22. A method as claimed in claim 18, in which the first axial direction has a first angular component of between 1° and 10° deviation from perpendicular with respect to the axis of the barrel, and the second axial direction has a second angular component is substantially the same value as the first angular component, but in the opposite axial direction.

23. A method as claimed in claim 18, in which the line is spooled in the first direction again as the barrel reaches the end of its first revolution and begins its second revolution.

24. A method as claimed in claim 18, in which the axial distance travelled in the first direction by the line during first half cycle of the barrel is more than the axial distance travelled in the second direction during the second half cycle.

25. A method as claimed in claim 18, in which selected layers of line are spooled from different rotational origins, whereby initial axial movement of line in at least two layers occurs at different circumferential positions.

26. A method as claimed in claim 18, in which radially adjacent layers of line are laid from opposing ends of the barrel.

27. A winch drum having a barrel adapted to receive a line that is wound around the barrel, the barrel having a guide device for guiding the line onto the barrel, wherein the guide device guides the line onto the barrel at a point that moves axially with respect to the barrel as the barrel rotates and wherein the guide device is configured to guide the line on an outward excursion in a first axial direction, to reverse the axial direction of winding of the line onto the barrel at least once per winding revolution, and to guide the line in a second axial direction which is opposite to the first axial direction, wherein the guide device comprises one or more grooves in at least a portion of the surface of the winch drum.

* * * * *